US012760511B2

(12) United States Patent
Wang

(10) Patent No.: US 12,760,511 B2
(45) Date of Patent: Oct. 13, 2026

(54) FOLDABLE LIVING COMPARTMENT

(71) Applicant: Nan Ya Plastics Corporation, Taipei (TW)

(72) Inventor: Kuei-Yung Wang, Taipei (TW)

(73) Assignee: Nan Ya Plastics Corporation (TW)

( * ) Notice: Subject to any disclaimer, the term of this patent is extended or adjusted under 35 U.S.C. 154(b) by 0 days.

(21) Appl. No.: 18/766,888

(22) Filed: Jul. 9, 2024

(65) Prior Publication Data

US 2024/0360661 A1 Oct. 31, 2024

Related U.S. Application Data

(60) Provisional application No. 63/556,501, filed on Feb. 22, 2024.

(51) Int. Cl.

| | |
|---|---|
| ***E04B 1/344*** | (2006.01) |
| ***E04B 1/90*** | (2006.01) |
| ***E04B 1/94*** | (2006.01) |

(52) U.S. Cl.

CPC ..... *E04B 1/3442* (2013.01); *E04B 1/90* (2013.01); *E04B 1/941* (2013.01)

(58) Field of Classification Search

CPC ..... E04B 1/3442; E04B 1/90; E04B 1/941; E04B 1/34315; E04B 1/343; E04B 1/344; E04B 1/34321

See application file for complete search history.

(56) References Cited

U.S. PATENT DOCUMENTS

| | | | | |
|---|---|---|---|---|
| 2,167,557 | A | 7/1939 | Stout | |
| 5,461,832 | A | 10/1995 | Smith | |
| 5,596,844 | A * | 1/1997 | Kalinowski | E04B 1/3442 52/79.5 |
| 5,966,956 | A * | 10/1999 | Morris | E04B 1/3444 52/79.5 |
| 7,117,645 | B2 | 10/2006 | Bzorgi | |
| 8,166,715 | B2 | 5/2012 | De Azambuja | |
| 8,201,362 | B2 | 6/2012 | Alford | |
| 8,720,126 | B2 | 5/2014 | Strickland | |
| 8,763,315 | B2 * | 7/2014 | Hartman | E04B 1/343 52/79.5 |
| 8,806,810 | B2 | 8/2014 | Barragan Olaya | |
| 9,085,890 | B2 | 7/2015 | Strickland | |
| 9,103,111 | B2 * | 8/2015 | Nakajima | E04B 1/3442 |
| 9,302,709 | B1 * | 4/2016 | Kumar | B62D 25/02 |
| 9,416,528 | B2 | 8/2016 | Schaffert | |
| 9,441,358 | B2 * | 9/2016 | Hartman | E04B 1/344 |
| 9,611,637 | B2 | 4/2017 | Dynan | |

(Continued)

FOREIGN PATENT DOCUMENTS

WO WO-2020047617 A1 * 3/2020 ..... E04B 1/02

*Primary Examiner* — Andrew J Triggs

(74) *Attorney, Agent, or Firm* — OSTROLENK FABER LLP

(57) ABSTRACT

A foldable living compartment comprising a ceiling, a floor and a sidewall disposed between the ceiling and the floor, the sidewall comprises two or more panels engaged with each other to enable the living compartment to transit between an expanded state and a collapsed state, each of the panels comprising: (i) a first subpanel, and (ii) a second subpanel opposing the first subpanel, the first subpanel being spaced apart from the second panel defining a chamber trapping a layer of air therebetween.

15 Claims, 34 Drawing Sheets

(56) References Cited

U.S. PATENT DOCUMENTS

| | | | | |
|---|---|---|---|---|
| 9,840,851 | B2 * | 12/2017 | Propst | E04B 1/941 |
| 10,415,263 | B2 | 9/2019 | Lucho Do Valle | |
| 10,519,647 | B2 * | 12/2019 | Crozier | E04B 1/3445 |
| 10,648,169 | B2 | 5/2020 | Lucho Do Valle | |
| 10,697,171 | B2 | 6/2020 | Melo | |
| 11,149,430 | B2 * | 10/2021 | Segall | E04C 2/205 |
| 11,629,493 | B2 * | 4/2023 | Livingstone | E04C 2/48 52/91.3 |
| 11,739,547 | B2 * | 8/2023 | Tiramani | E04C 1/39 52/79.9 |
| 11,866,927 | B2 | 1/2024 | Keys | |
| 11,974,417 | B2 * | 4/2024 | Deighton | H05K 9/0084 |
| 12,000,136 | B2 * | 6/2024 | Wang | E04B 1/34315 |
| 12,012,031 | B2 * | 6/2024 | Lozier | B32B 3/12 |
| 12,214,711 | B2 | 2/2025 | Lontz | |
| 12,389,577 | B2 * | 8/2025 | Lontz | E04B 1/34384 |
| 2013/0232887 | A1 | 9/2013 | Donnini | |
| 2014/0311051 | A1 * | 10/2014 | Fagan | E04B 1/343 52/79.5 |
| 2016/0138258 | A1 * | 5/2016 | Schaffert | E04B 1/3445 52/79.5 |
| 2018/0363318 | A1 | 12/2018 | Johnson | |
| 2020/0299959 | A1 * | 9/2020 | Lozier | B32B 27/36 |
| 2020/0332512 | A1 * | 10/2020 | Smith | E04B 1/34384 |
| 2022/0396947 | A1 | 12/2022 | Moore | |
| 2024/0060291 | A1 | 2/2024 | Tiramani | |
| 2024/0200322 | A1 | 6/2024 | Chen | |
| 2024/0360661 | A1 | 10/2024 | Wang | |
| 2024/0392556 | A1 | 11/2024 | Chen | |

* cited by examiner

FOLDABLE LIVING COMPARTMENT

TECHNICAL FIELD

The present invention relates to a foldable living compartment. More particularly, the present invention relates to a foldable living compartment with improved insulation.

BACKGROUND OF THE INVENTION

Foldable living compartments are known to be a quick solution to meet the need for temporary accommodation. Such a living compartment can be folded into a compact structure for easy storage and transport. When in use, it can be unfolded to form a reasonably sized enclosed space that serves as a reusable sheltered living area.

Currently, most foldable living compartments on the market consist of holes cut into metal panels to form side walls, pre-prefabricated windows and doors installed, and an exterior coating of thermal insulation. However, the metal panels do not provide sufficient insulation, particularly thermal insulation, which can lead to uncomfortable living conditions in extreme weather conditions. In addition, the metal panels of modular houses do not provide adequate sound insulation, which means that external noises such as raindrops hitting the roof and blowing of wind can be very disturbing to the occupants.

Poor soundproofing may also compromise privacy, as any noise or conversation made by the occupants can be heard by neighbours. It is thus crucial to address these issues to ensure a comfortable and private living space.

The invention seeks to eliminate or at least mitigate such shortcomings by providing a foldable living compartment with improved insulation.

SUMMARY OF THE INVENTION

According to a first aspect of the present invention, there is provided a foldable living compartment comprising a ceiling, a floor and a sidewall disposed between the ceiling and the floor, wherein the sidewall comprises two or more panels engaged with each other to enable the living compartment to transit between an expanded state and a collapsed state, each of the sidewall panels comprising: (i) a first subpanel, and (ii) a second subpanel opposing the first subpanel, wherein the first subpanel is spaced apart from the second subpanel defining a chamber trapping a layer of air therebetween.

In an embodiment, the living compartment is configured to have a maximum volume in the expanded state and a minimum volume in the collapsed state. and a minimum volume in the collapsed state, the maximum volume to minimum volume ratio is about 2.8 to 1.66

In an embodiment, the chamber is fillable with materials selected from a fire-resistant material, a heat insulating material, a sound insulating material, or a combination thereof.

In an embodiment, the first subpanel and the second subpanel are spaced apart at a distance adjustable to provide a predetermined insulation effect.

In an embodiment, the ceiling comprises one or more ceiling panels, wherein each of the ceiling panels comprising: (i) a first ceiling subpanel, and (ii) a second ceiling subpanel opposing the first ceiling subpanel, wherein the first ceiling subpanel is spaced apart from the second ceiling subpanel defining a chamber trapping a layer of air therebetween.

In an embodiment, the floor comprises one or more floor panels, wherein each of the floor panels comprising: (i) a first floor subpanel, and (ii) a second floor subpanel opposing the first floor subpanel, wherein the first floor subpanel is spaced apart from the second floor subpanel defining a chamber trapping a layer of air therebetween.

In an embodiment, the foldable living compartment further comprising a main frame for accommodating at least the ceiling, the floor and the sidewall, and configured to permit relative movement between the ceiling and the floor relative to the sidewall.

In an embodiment, an outer surface of the main frame is covered with an insulating material.

In an embodiment, the main frame further comprising supplementary frame members, configured to provide mechanical reinforcement to the ceiling, the floor and the sidewall.

In an embodiment, the supplementary frame members are positioned within the chamber of each of the panels.

In an embodiment, the sidewall includes a door, a window or a combination thereof.

In an embodiment, the chamber includes a first chamber and a second chamber, the first chamber of the first panel is in fluid communication with the second chamber of the second panel.

In an embodiment, the first and second chambers are connected by a passageway configured to accommodate network wires, electrical cables, pipes or a combination thereof.

In an embodiment, the ceiling comprises a first ceiling panel and a second ceiling panel.

In an embodiment, the first ceiling panel is in engagement with the sidewall, and the second ceiling panel is movably connected with the first ceiling panel to enable the second ceiling panel to move relative to the first ceiling panel.

In an embodiment, the second ceiling panel is connected to the sidewall via a hydraulic arm or a powered rod.

In an embodiment, the floor comprises a first floor panel and a second floor panel.

In an embodiment, the first floor panel is in engagement with a second edge of the sidewall, and the second floor panel is movably connected with the first floor panel to enable relative movement there between.

In an embodiment, the sidewall comprises a plurality of sidewall panels movably engaged with each other, enabling the sidewall to move between an expanded state, and a collapsed state.

In an embodiment, the panels are connected with each other in a manner to enable the transition between the expanded and collapsed states to proceed in a continuous motion.

According to a second aspect of the present invention, there is a panel applicable as a ceiling, a floor or a sidewall of a foldable living compartment, wherein the panel comprising: (i) a first subpanel, and (ii) a second subpanel opposing the first subpanel, wherein the first subpanel is spaced apart from the second subpanel defining a chamber trapping a layer of air therebetween.

BRIEF DESCRIPTION OF THE DRAWINGS

In order that a more previse understanding of the above-recited invention can be obtained, a more particular description of the invention briefly described above will be rendered by reference to specific embodiments thereof that are illustrated in the appended drawings. The drawings presented herein may not be drawn in scale and any reference to dimensions in the drawings or the following description is specific to the embodiments disclosed.

DETAILED DESCRIPTIONS OF THE DRAWINGS

Figure 1A:
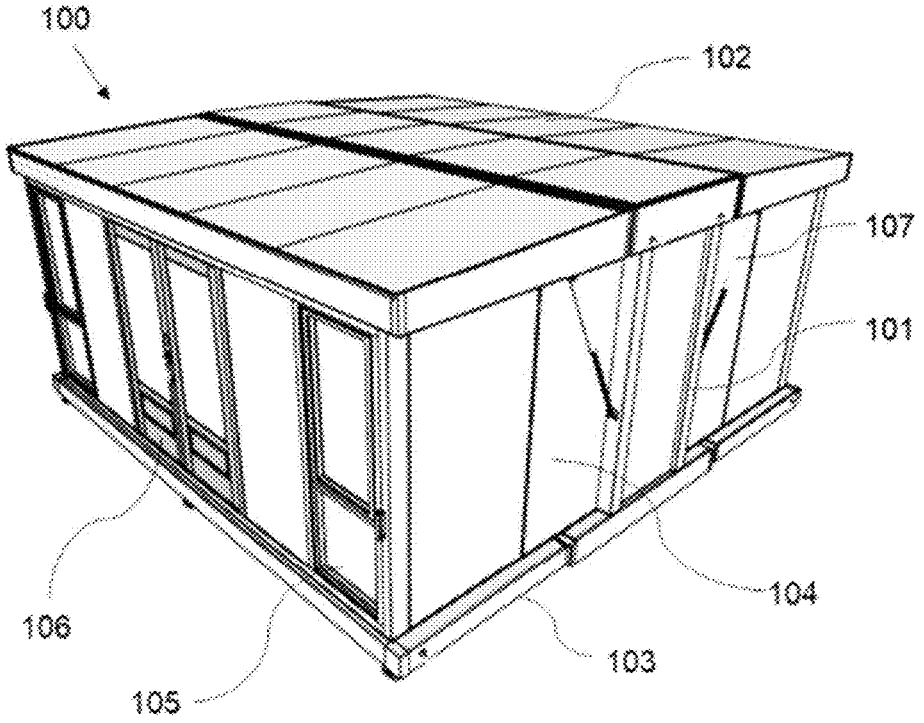
FIG. 1*a* is a perspective view of a foldable living compartment according to an embodiment the present invention.

FIG. 1*a* shows a foldable living compartment 100 according to the present invention. For ease of transport, the compartment 100 is kept in a folded state to save space. It is then assembled and expanded to its fully expanded state, as shown in FIG. 1*a*, on arrival at the site of use so as to provide a living compartment of a reasonable size for habitation. The area within the living compartment 100 reaches its maximum in the expanded state, and reduces the its minimum in the folded state.

The foldable living compartment 100 comprises a main frame 101 for supporting the mechanical structure of the compartment 100. The main frame 101 includes joints and articulations to allow movement of the living compartment 100 between an expanded state and a folded/collapsed state. The main frame 101 is configured to enable ceiling panels 102, floor panels 103, a plurality of sidewall panels 104 and a door 106, windows 105 to mount thereon.

To enable smooth movement between the panels, movement rods 107 such as hydraulic arms or powered rods are deployed between the movable connections, which in the present embodiment are between the ceiling panels 102 and a central portion of the sidewall, to assist the expanding and folding movement of the ceiling panels 102 against the sidewall and also to provide structural reinforcement.

Figure 1B:
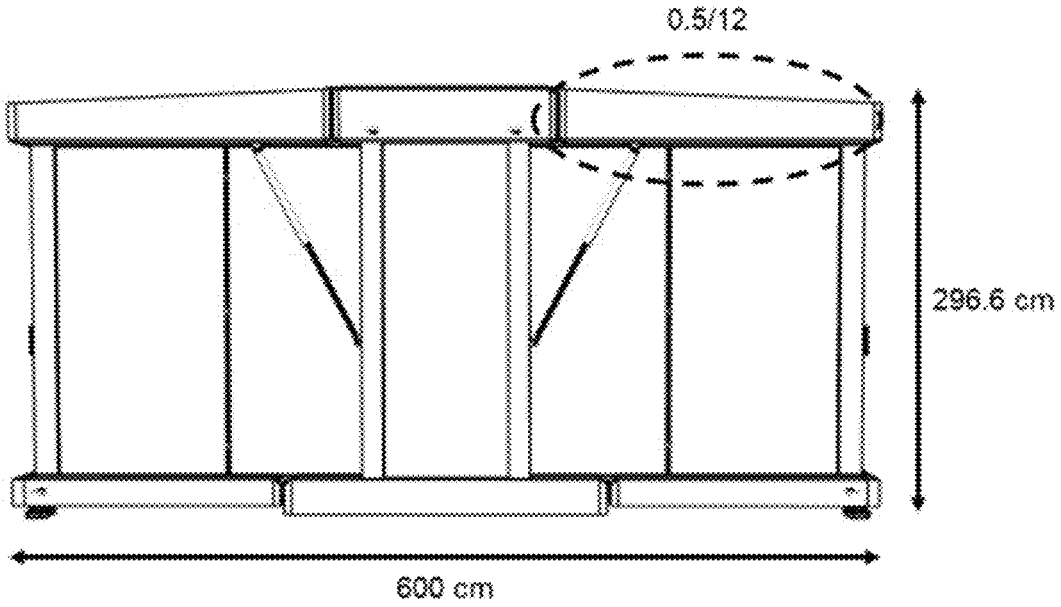
FIG. 1*b* demonstrates the dimension of an embodiment of the foldable living compartment according to the present invention.

FIG. 1*b* demonstrates the dimensions of an embodiment of the foldable living compartment according to the present invention. The dimensions of the foldable living compartment in the expanded state and the folded state (collapsed state) are shown in table 1 and table 2.

TABLE 1

| Dimensions (expanded state) | Length × Width × Height (cm) |
|---|---|
| Exhibition Version | 600 × 580 × 240 |
| Production Version | 600 × 600 × 296.6 |

TABLE 2

| Dimensions (folded state) | Length × Width × Height (cm) |
|---|---|
| Exhibition Version | 600 × 214 × 240 |
| Production Version | 600 × 254.2 × 296.6 |

The ratio of size of the foldable living compartment in the expanded state to the size of the foldable living compartment in the folded state is about 1.66. The preferred expanded size of the foldable compartment is 6000 mm×6000 mm×2986 mm and the preferred folded size of the foldable compartment is 6000 mm×3609 mm×2986 mm. The preferred interior height is 2400 mm. The height of the indoor of the foldable living compartment is 213 cm in the exhibition version, and 213 cm in the production version. The roof slope is 0 degree in the exhibition version and 2.5 degrees in the production version.

Figure 2A:
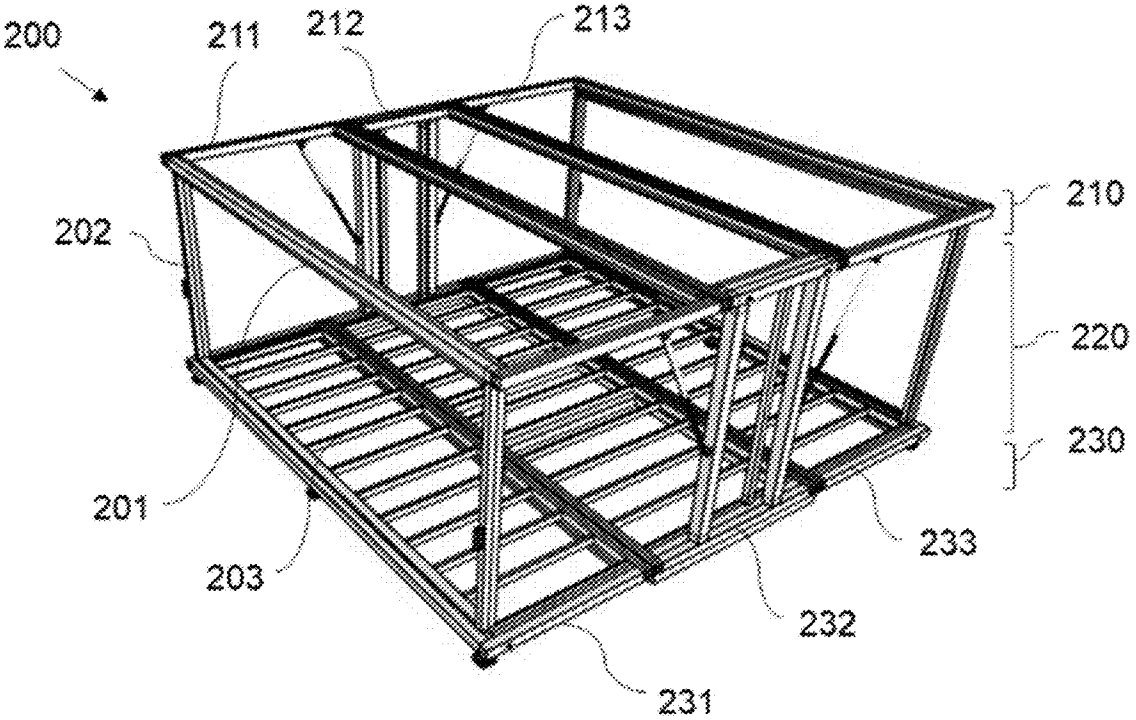
FIG. 2*a* is a perspective view of a main frame of the foldable living compartment of FIG. 1*a;*
Figure 2B:
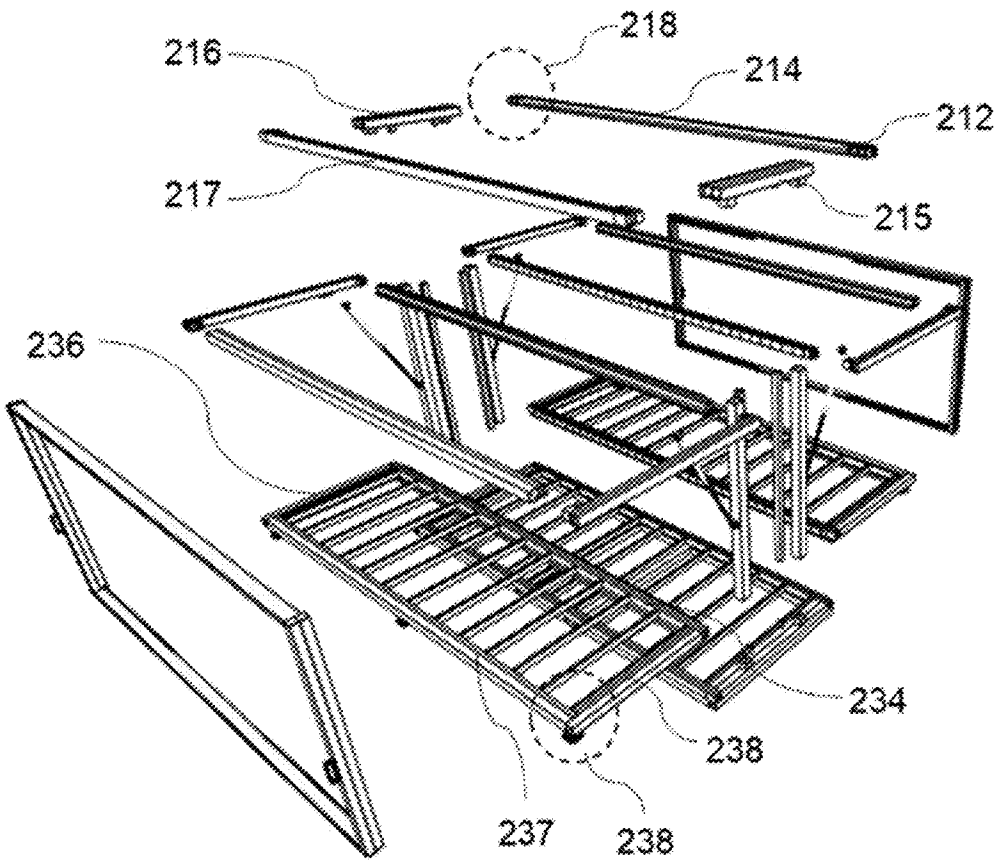
FIG. 2*b* is an exploded view of the main frame of FIG. 2*a;*
Figure 3:
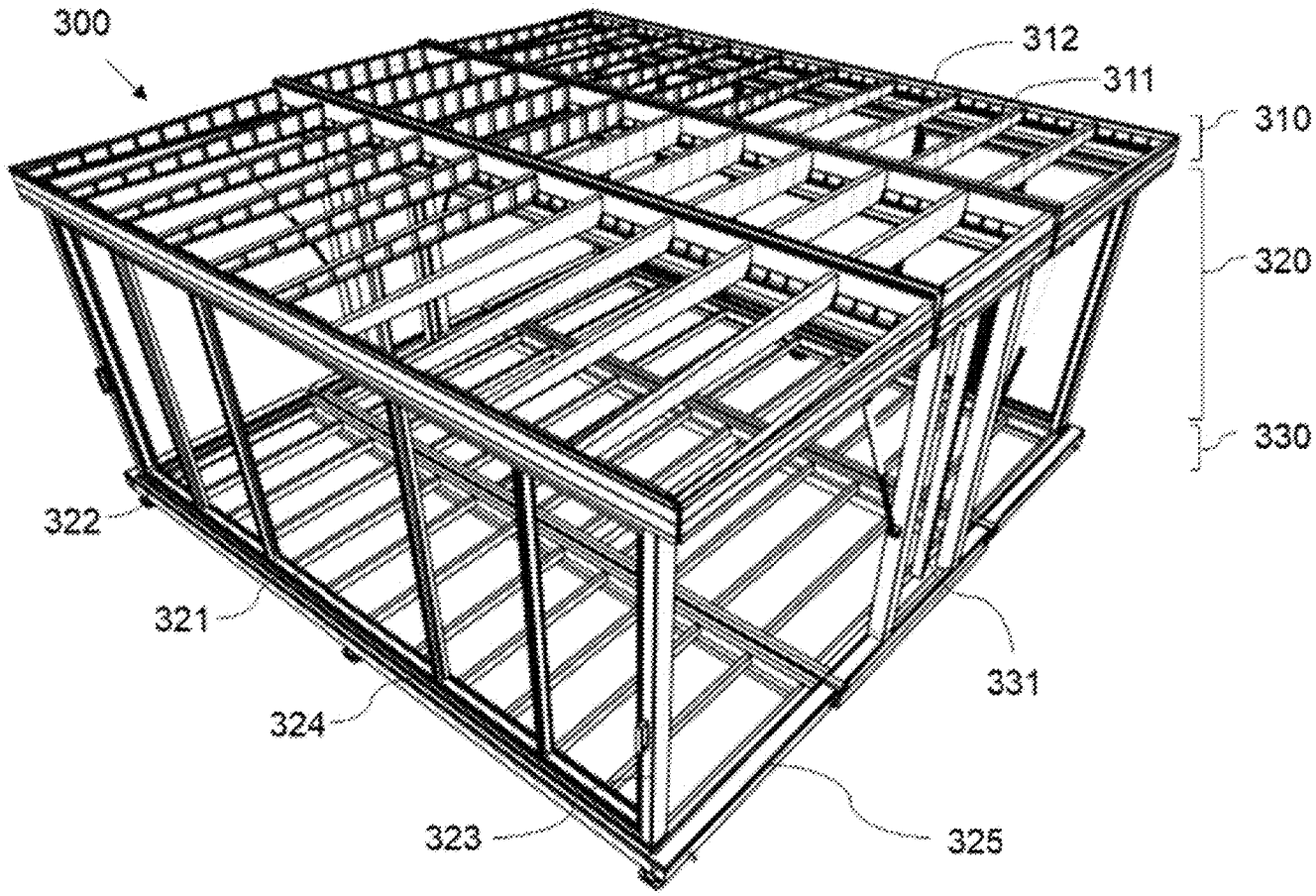
FIG. 3 is a perspective view of the main frame of FIG. 2*a* with a frame cover applied thereto.

FIGS. 2*a*, 2*b* and 3 show a main frame 200 as such and a frame structure 300. The frame structure 300 comprises the main frame 200 in combination with members of an insulated frame cover made of insulating material which covers part of the main frame 200.

In a preferred embodiment, the main frame 200 is made of lightweight steel which provides adequate mechanical support for the living compartment while remaining lightweight for efficient transport. However, the metal frame, which is of higher thermal conductivity than the surrounding material, creates a path of least resistance for heat transfer also known as thermal bridge.

Thermal bridges in the building structure can have a significant impact on the heat transfer into and out of the living compartment, and therefore increases the amount of energy required to heat and cool a compartment (provided by an air-conditioner and a heater for example), as well as causing condensation within the compartment causing discomfort in the living environment.

This is especially problematic when the cross beams 201 and columns 202, which are made of metal, are exposed to the external environment. To address this problem, members of the insulating frame cover which are made of insulating materials, such as polyvinyl chloride (PVC) and other plastics, are used to cover at least a portion of the main frame 200. This reduces the overall thermal conductivity of the frame structure 300, thereby minimizing heat transfer into and out of the living compartment via thermal bridges.

As shown in FIG. 2*a*, the main frame 200 comprises a ceiling frame structure 210, a sidewall frame structure 220 and a floor frame structure 230 for supporting a ceiling, a sidewall and a floor respectively. To allow the living compartment to transit between an expanded state and a collapsed state, the ceiling frame structure 210 and/or the floor frame structure 230 are movably interconnected with the sidewall frame structure 220 to enable movement. In a preferred embodiment, the frame members are hingedly engaged with each other.

In the present embodiment, the ceiling frame structure 210 comprises three ceiling frame members, the first and second ceiling frame members 211 and 213 are hinged to either side of a third ceiling frame member 212, forming a triple-fold frame structure. Likewise, the floor frame structure 230 consists of three floor frame members 231, 232, and 233. A triple-fold frame structure is formed by hinging a first and second floor frame member, 231 and 233 respectively, to either side of a third floor frame member 232. Each of the floor frame members 231, 232, 233 further comprises supplementary frame members 203 for mechanical reinforcement.

In an exploded view as shown in FIG. 2*b*, a ceiling frame member 212 comprises of four ceiling structural tubes 214, 215, 216, 217 interconnected with each other at the end portions to form a rectangular structure. In a preferred embodiment, the ceiling structural tubes 214, 215, 216, 217 include a coupling element 218 at each end portion, allowing them to be easily connected with each other. Alternatively, the ceiling structural tubes are spot-weld together. Similarly, the floor frame member 232 consists of four structural tubes 234, 235, 236, 237 that are preferably spot-welded 238 together. Coupling elements may also be included at the end portions of the tubes for interconnection via coupling. Preferably, each of the structural tubes have the thickness between 3 mm and 5 mm.

FIG. 3 shows the frame structure 300 provided with members of an insulating frame cover made of insulating materials. Same as the main frame 200, the frame structure 300 comprises a ceiling frame structure 310, a sidewall frame structure 320 and a floor frame structure 330. A beam holder 311 including multiple beam members 312 which covers the steel ceiling frame to enhance insulation and also act as the supplementary frame members to reinforce the mechanical structure. Said beam holder 311 is preferably formed from acrylonitrile butadiene styrene (ABS). Alternatively, it can also be formed from other tough and durable insulating materials.

The frame structure 300 further includes a window frame 322, a door frame 321, a vertical sidewall frame 324, a fixing plate for vertical wall enclosure 323, a ground fixed border stop 325 and an interior fixing plate 331. These frame members are preferably formed from PVC, PVC foams, or other plastics.

The majority of foldable living compartments on the market are constructed with thin metal plates for their sidewalls and ceiling panels. This is because thin metal plates are easily accessible as building materials and are lightweight, making them easy to transport. Alternative materials include thin PVC panel boards which serve as a skin to the exterior of the sidewall. However, such PVC skin usually has negligible thickness that it is thus unable to provide adequate insulation, both thermally and acoustically, to the foldable living compartment.

Figure 4:
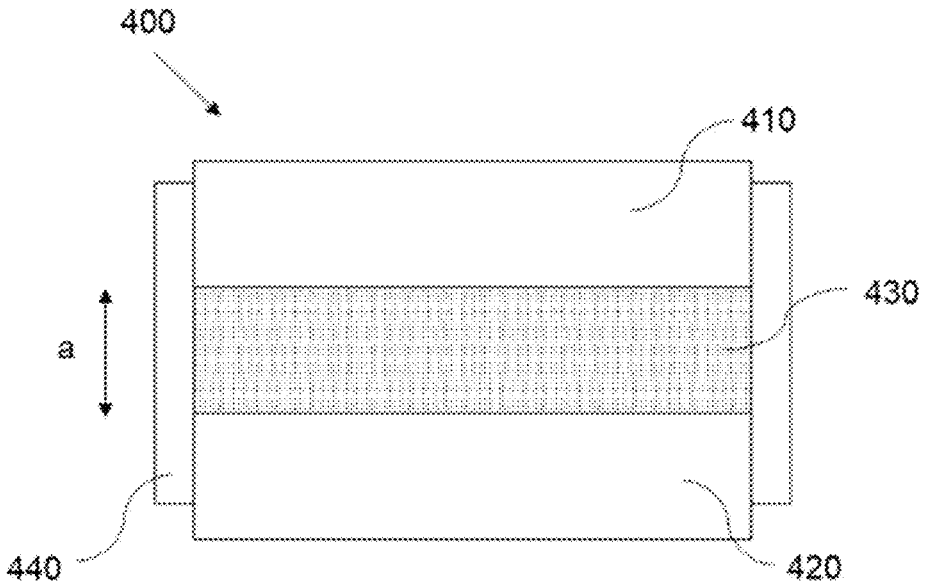
FIG. 4 is a section view of an embodiment of a sidewall panel according to the present invention.

Referring now to FIG. 4 which depicts a sectional view of a sidewall panel 400 of a foldable living compartment according to the present invention. The sidewall panel 400 comprises an inner subpanel 420 and an outer subpanel 410 spaced apart from each other by a distance a. The peripheries of both the inner subpanel 410 and the outer subpanel 420 are sealed with sealing components 440, thereby defining an enclosed chamber 430 in between which traps a layer of air. Such chamber 430 is well insulated such that both the thermal and acoustic conductivity thereof is lower than that of the materials of the inner and outer subpanels 410, 420 and the sealing components 440. This can reduce thermal and acoustic transfer into and out of the living compartment via the sidewall panels 400, providing a more comfortable living environment to the habitants.

The inner and outer subpanels 410, 420 are preferably made of PVC with glass fibre sheet attached on both sides. The insulated chamber 430 may be filled with gas, or is fillable with different materials to achieve varying performances, for example in order to enhance the fire-resistance properties of the living compartment, the chamber 430 is filled with phenolic foam, whereas if it is desired to further improve insulation, PU foam can be used as the filing material instead.

To meet the building code requirements for thermal resistance, thicknesses a of the insulated chamber can be adjusted to achieve the desired insulation effect.

Figure 5:
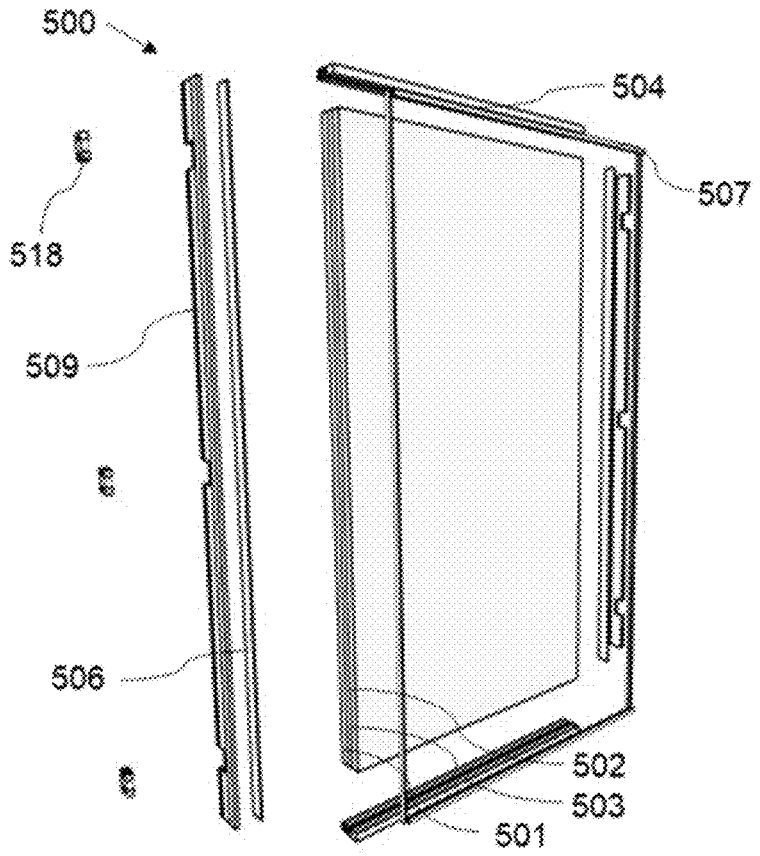
FIG. 5 is an exploded view of the sidewall panel of FIG. 4.

FIG. 5 shows an exploded view of the sidewall panel 500 of FIG. 4. As is shown, the sidewall panel 500 comprises an inner subpanel 502 and an outer subpanel 501, each with a significant thickness aiming to provide adequate insulation. In a preferred embodiment, both the inner and outer subpanels 501, 502 are of 35 mm thickness, and are made of a sheet moulding compound (SMC) which are also known as a ready-to-mould glass-fibre reinforced polyester material. Alternatively, the inner and outer subpanels 501, 502 are made from other insulating materials. The inner and outer subpanels 501, 502 are spaced apart from each other defining an insulated chamber 503 therebetween, wherein the thermal conductivity of the insulated chamber 503 is lower than that of the inner and outer subpanels. Preferably, the thickness of the chamber is at least 30 mm.

When in use, the upper edge of the sidewall panel 500 is in contact with the ceiling of the living compartment whereas the lower edge of the sidewall panel 500 is in contact with the floor. The upper and lower edges of both the inner and outer subpanels 501, 502 are sealed with inner peripheral frames 504. Together with the side sealing panels 506, an insulated chamber 503 is defined between the inner and outer subpanels 501, 502.

The inner peripheral frames 504 also serve to engage with the main frame of the foldable living compartment.

The outer peripheral frames 509 are attached to an outer surface of the side sealing panels 506 for engagement with another sidewall panel. Both the inner and outer peripheral frames 504, 509 include coupling elements for engagement. The coupling elements may be threads or other patterns complementary in shape to the edges of the main frame and another panel. In particular, the side edges of the sidewall panel 500 further include a connecting element 518 which, in a preferred embodiment, is a hinge such that two sidewall panels are articulated to each other. This allows the two sidewall panels to move relative to each other in a sideway folding movement.

FIGS. 6*a*-6*d* show an exploded view of the panel structure of the foldable living compartment 600. The living compartment 600 includes a ceiling panel assembly 630, a first side wall panel assembly 640, a second sidewall panel assembly 650, and a floor panel assembly 660.

The ceiling panel assembly 630 includes an outermost ceiling panel 601, preferably made of SMC and in the thickness of 35 mm, a roof decorative cover 602 preferably made of PVC, a foamed PVC fixed frame and SMC beam structure system 603, a roof frame 604 preferably made of steel, and an innermost ceiling panel 605 also preferably made of SMC and in the thickness of 35 mm. The ceiling panel assembly 650 is configured in a manner such that the outermost ceiling panel 601 and the innermost ceiling panel 605 are separated by a distance, creating an insulated chamber between them. This reduces thermal and acoustic transfer into and out of the living compartment 600 through the ceiling panel assembly 650.

Figure 6A:
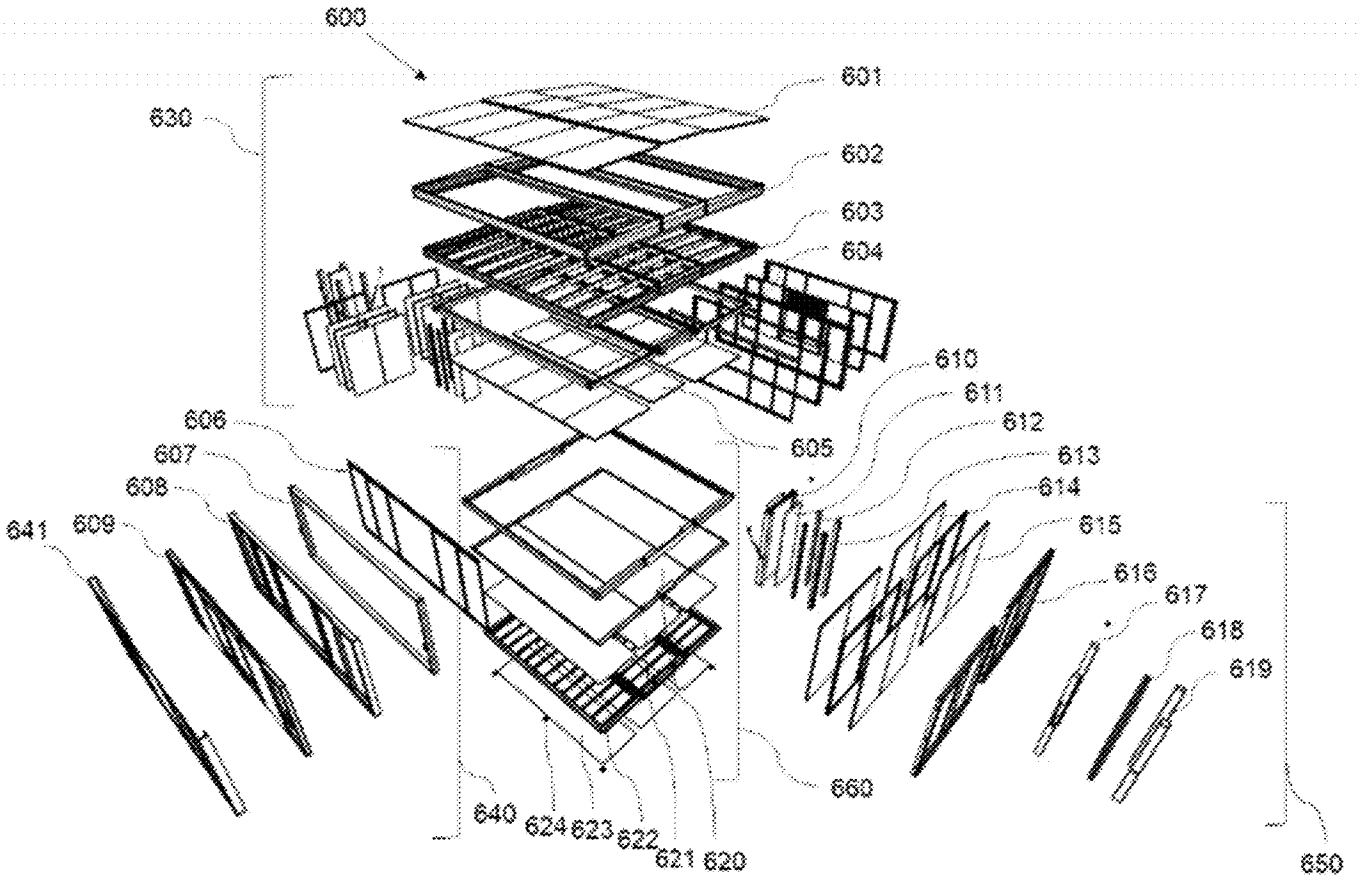
FIG. 6*a* is an exploded view of an embodiment of an internal structure of the foldable living compartment of FIG. 1*a;*
Figure 6B:
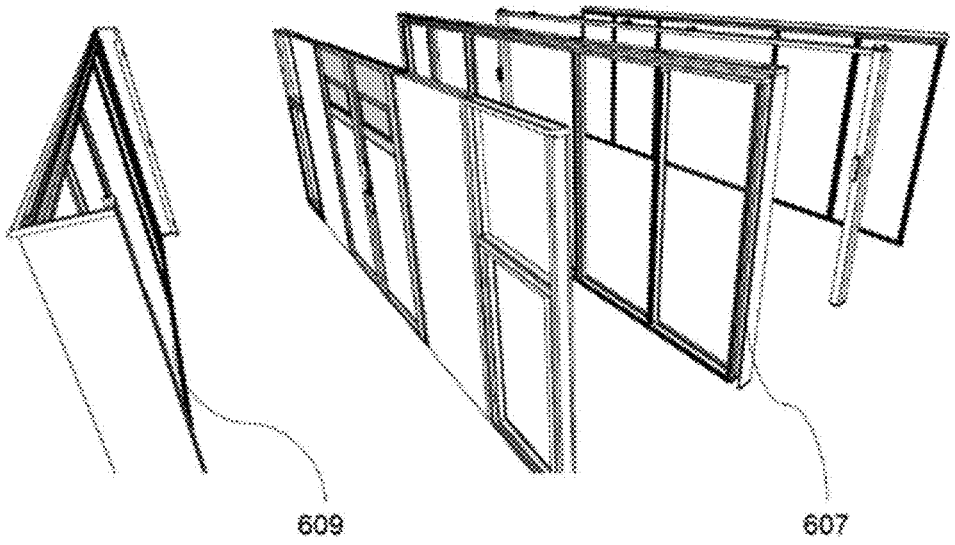
FIG. 6*b* is an exploded view of the sidewall panel structure of FIG. 6*a* from a first perspective angle.
Figure 6C:
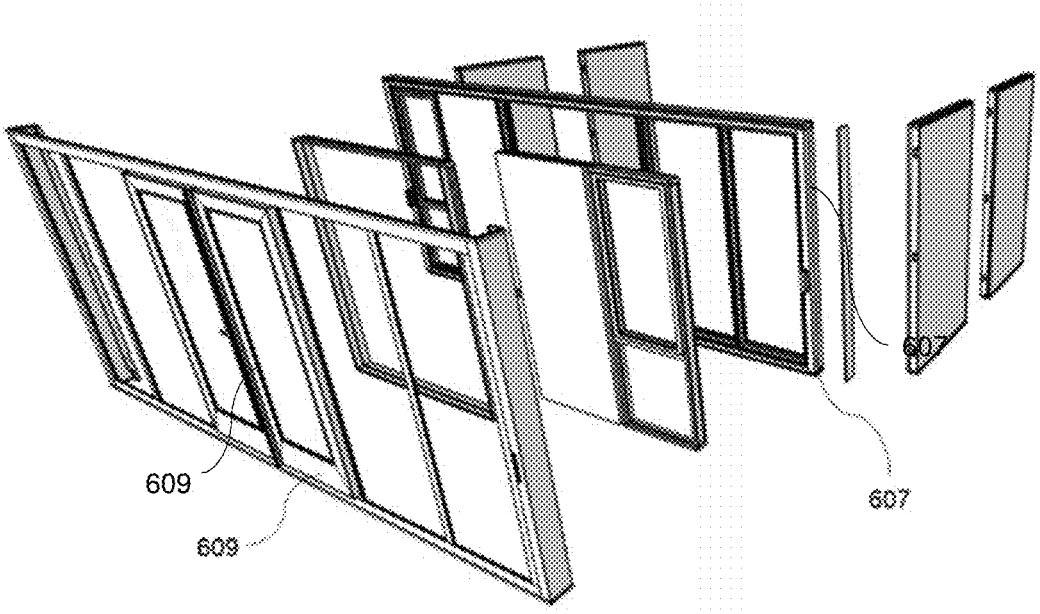
FIG. 6*c* is an exploded view of the sidewall panel structure of FIG. 6*a* from a second perspective angle.
Figure 6D:
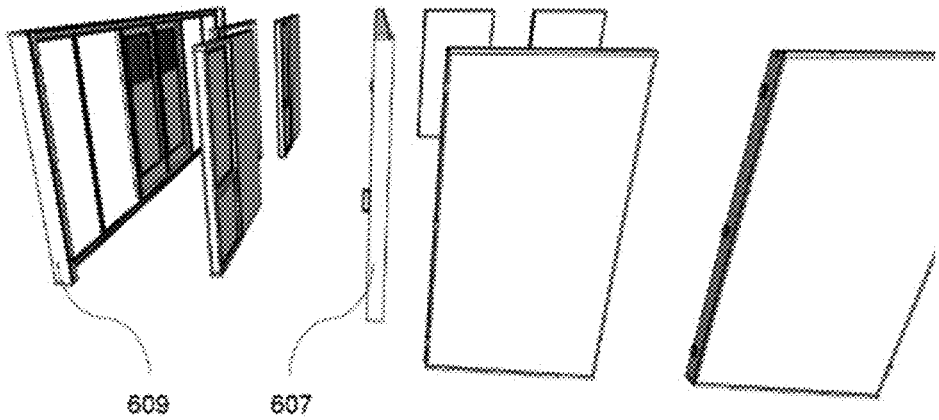
FIG. 6*d* is an exploded view of the sidewall panel structure of FIG. 6*a* from a side angle.

As shown in FIG. 6*a*, the first sidewall panel assembly 640 is non-foldable and has window panels and a door panel mounted thereon. Also referencing to FIGS. 6*a*, 6*b*, 6*c* and 6*d*, the first sidewall panel assembly 640 comprises a rigid interior decoration board 606 preferably made of PVC, a standing wall frame 607 preferably made of steel, wall material 608 preferably made of PVC foam, and a door and window system 609 preferably made of steel and plastics. The assembly 640 is covered by a rigid external wall cover 641, preferably made of PVC.

The second sidewall panel assembly 650 consists of at least two panels that are hinged together, which allow for folding movement between them. As shown in FIG. 6*a*, the second sidewall panel assembly 650 comprises a sealing plate 610 preferably made of SMC plastic, a wooden plywood 611, fixing components 612 preferably made of PVC foam, a rigid cover 613 preferably made of PVC, an inner subpanel 614 and an outer subpanel 615 both preferably made of SMC, with a layer of air trapped in between, a rigid exterior cover plate 616 preferably made of PVC, core columns 617 preferably made of steel, and a central wall panel 618 preferably made of SMC. The assembly also includes a rigid exterior cover plate 619, preferably made of PVC.

Still referring to FIG. 6*a*, the floor panel assembly 660 consists of an inner floor panel 620 preferably made of plastic and having a thickness of 3 mm, a wooden plywood 621 preferably having a thickness of 18 mm, a floor frame 622 preferably made of steel and a floor underlay 623 preferably having a thickness of 2 mm and made of SMC. Adjustable feet 624 for calibrating the floor level are also provided between the floor underlay 623 of the living compartment 600 and the ground. The floor panel assembly 660 is arranged so that an air layer is encapsulated between the interior floor panel 620 and the floor underlay 623. This layer of air serves to improve insulation and reduce thermal or acoustic transfer into and out of the living compartment via the floor.

Figure 7A:
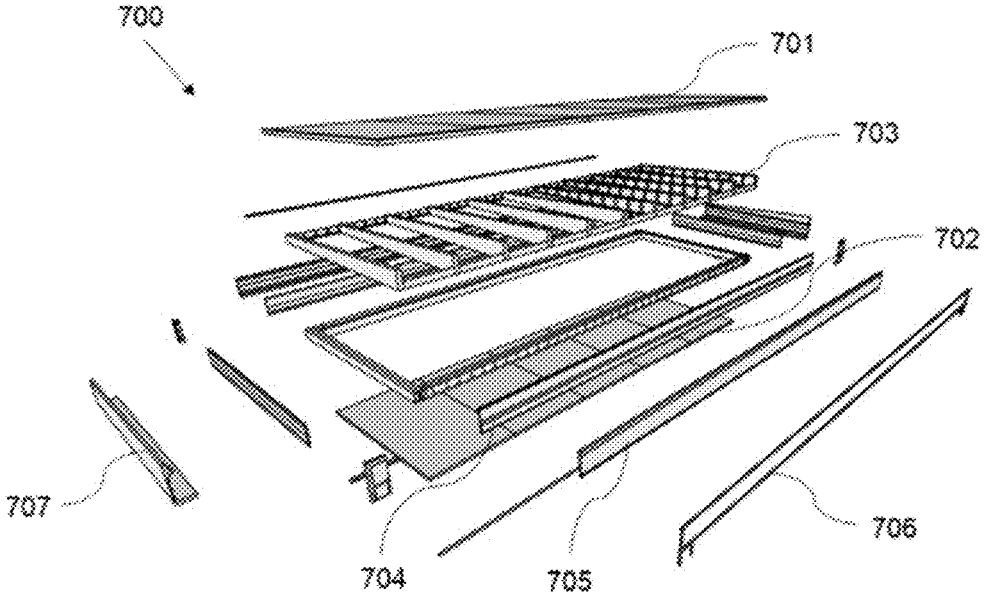
FIG. 7*a* is an exploded view of a ceiling of the foldable living compartment of FIG. 1*a* from a first perspective angle.
Figure 7B:
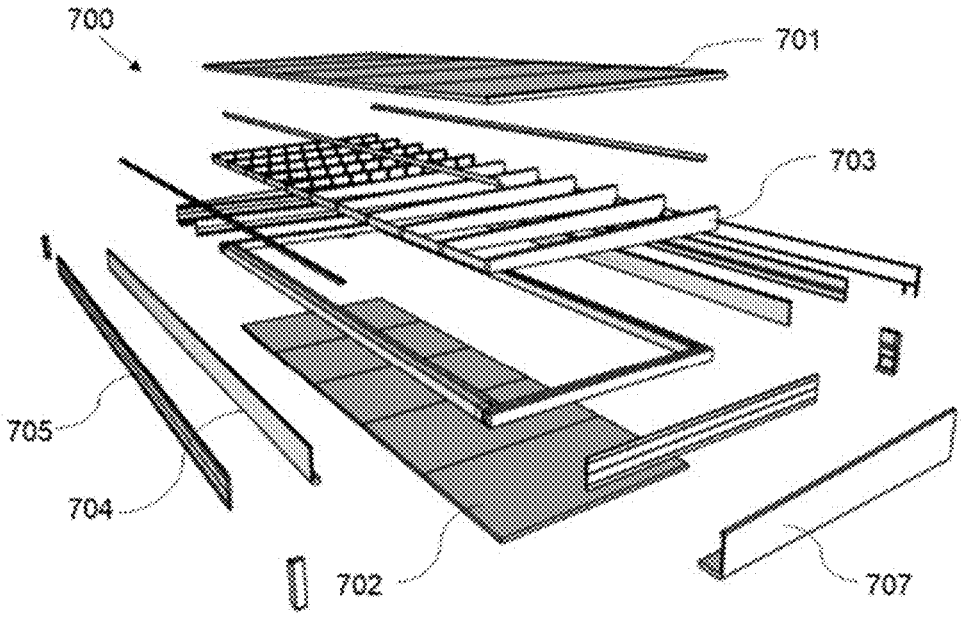
FIG. 7*b* is an exploded view of a ceiling of the foldable living compartment of FIG. 1*a* from a second perspective angle.
Figure 7C:
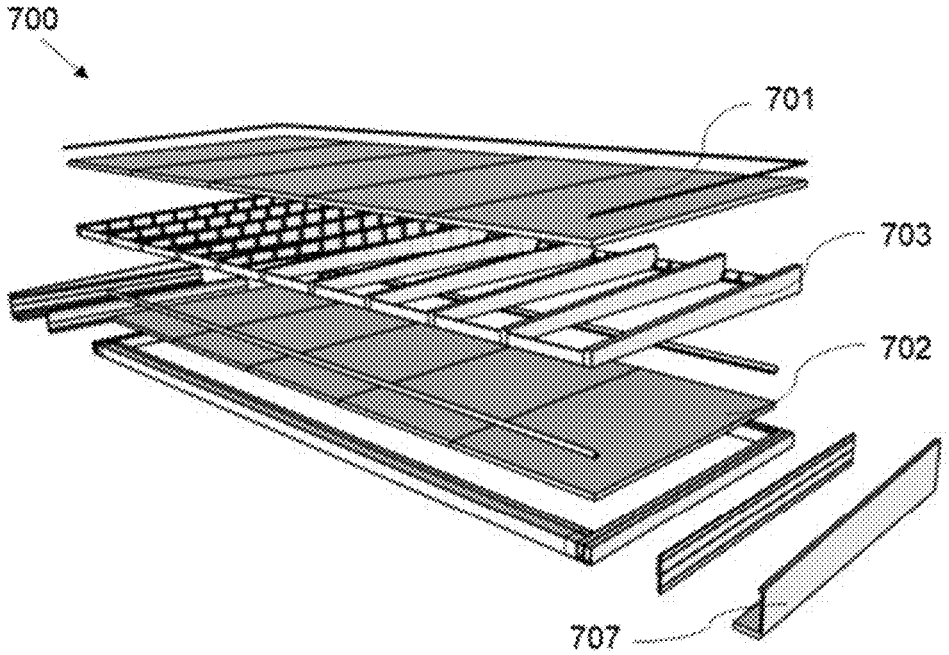
FIG. 7*c* is an exploded view of a ceiling of the foldable living compartment of FIG. 1*a* from a third perspective angle.

FIGS. 7*a*, 7*b* and 7*c* show an exploded view of the ceiling panel assembly 700. The ceiling panel assembly 700 comprises an outer ceiling panel 701 and an inner ceiling panel 702, held in position by a supporting frame 707 such that an insulated chamber is defined between the outermost and innermost ceiling panels 701, 702. The ceiling assembly is further reinforced by supplementary frame structures 703, a frame 704 and a cover 705. In one embodiment, the insulated chamber is fillable with insulating materials such as PVC foam or fire-resistant materials to improve the insulating and fire-resistant properties. The edges of the cover 705 are sealed with sealing components 706 to further enhance insulation.

Figure 8:
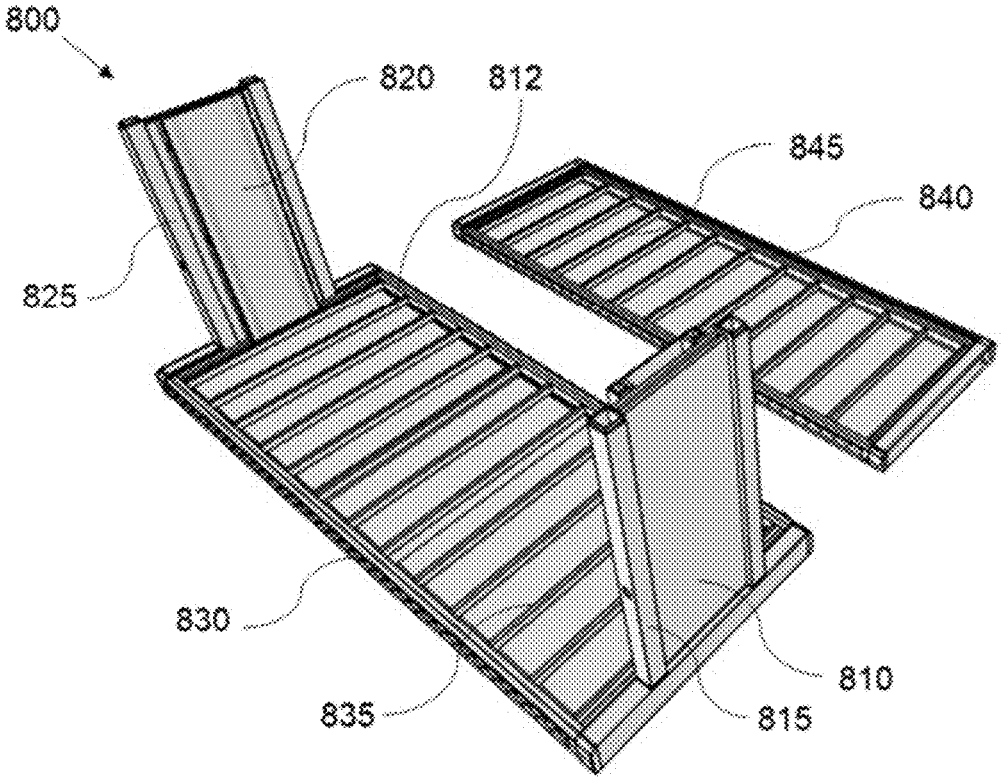
FIG. 8 shows central structure of the foldable living compartment of FIG. 1*a;*

The foldable living compartment of the present invention has a central structure 800 shown in FIG. 8. In this embodiment, the central structure 800 is located near the centre of the entire living compartment which allows a first and second compartments formed on either side on the central structure 800 to fold against it in the folded state. The central structure 800 comprises of sidewall panels 810, 820 on opposite sides, supported by central frame columns 815, 825. The sidewall panels engage with the central floor frame 830, which has multiple supplementary frame members for structural reinforcement. Another floor frame member 840 is hinged to the central floor frame 830, allowing folding movement between the two frames. The floor frame member 840 also has multiple beam structures 845 for additional reinforcement.

Figure 9A:
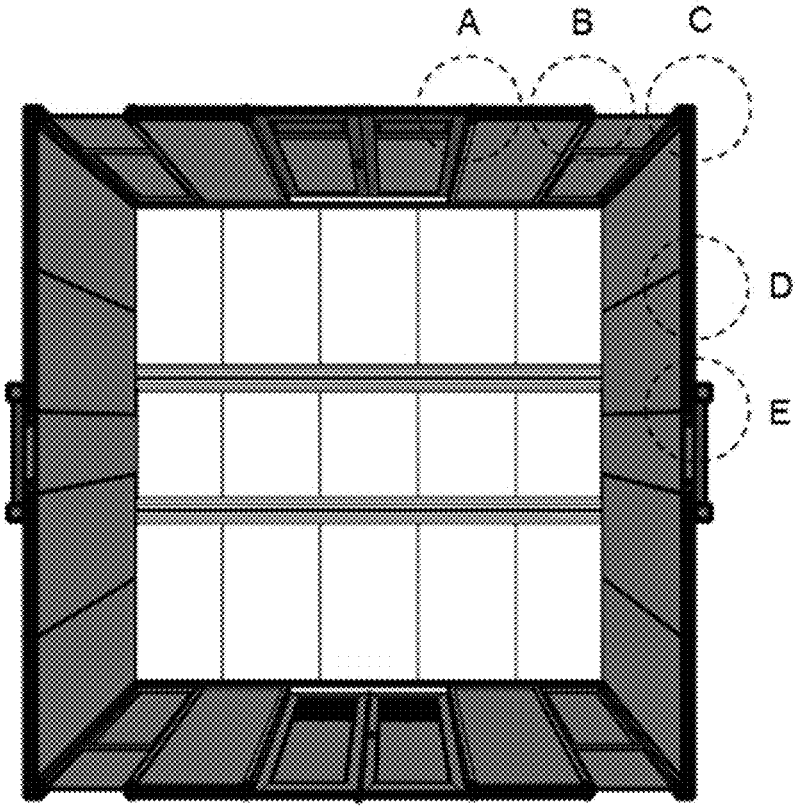
FIG. 9*a* is a top view of the foldable living compartment of FIG. 1*a;*
Figure 9B:
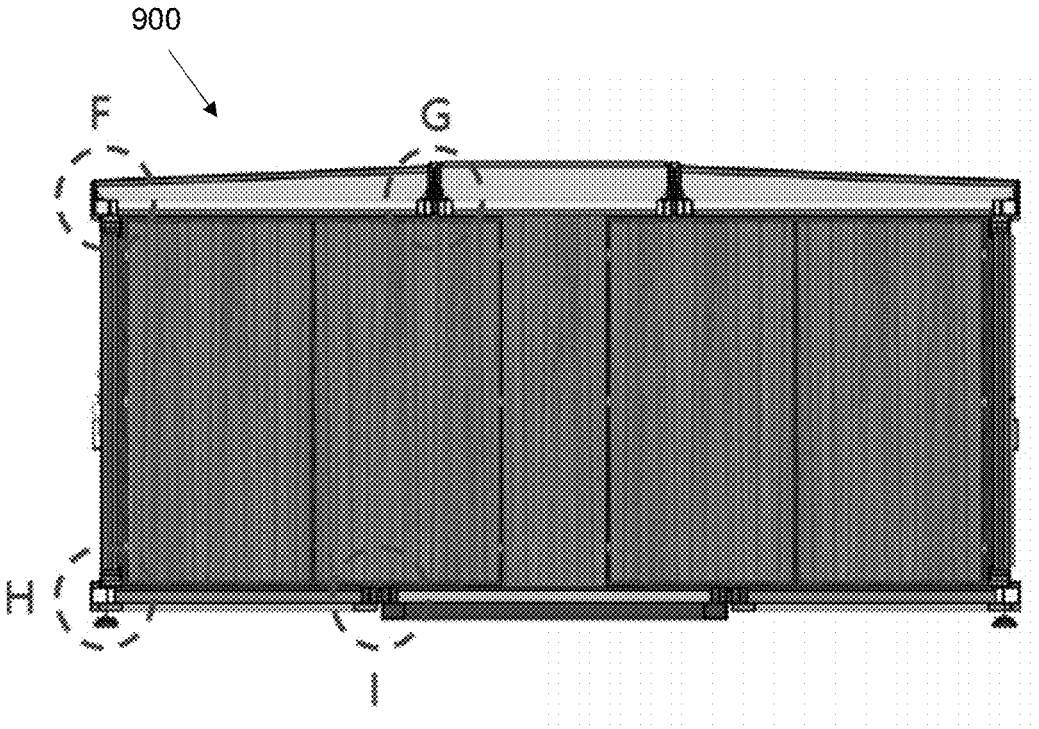
FIG. 9*b* is a side view of the foldable living compartment of FIG. 9*a;*
Figure 9C:
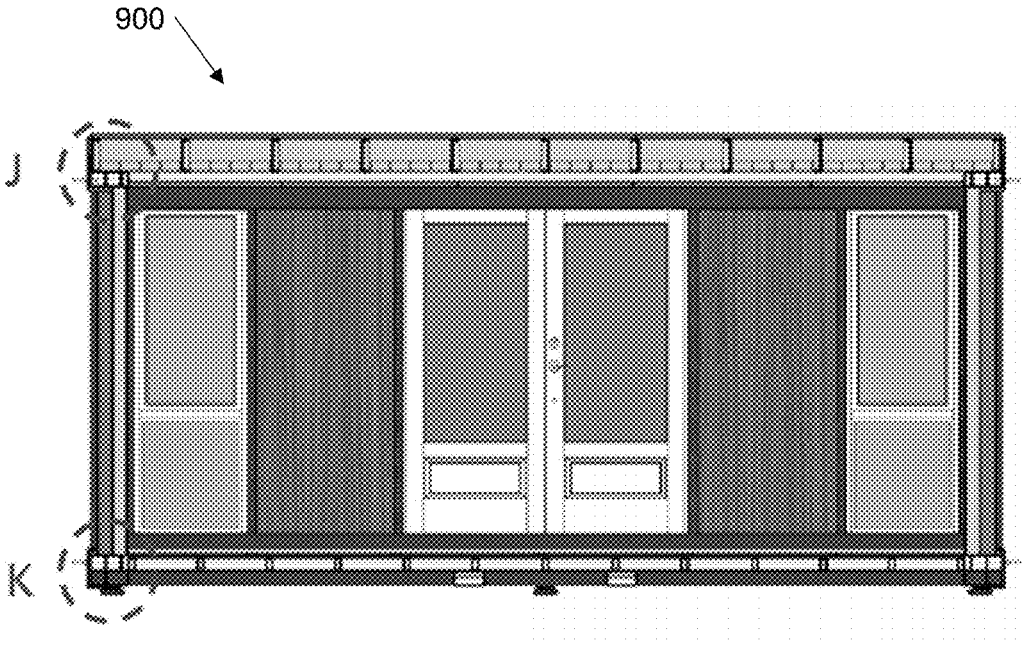
FIG. 9*c* is a front view of the foldable living compartment of FIG. 9*a;*

Cross sections of the living compartment 900 are shown in FIGS. 9*a*-9*c*, providing a top, front, and side view. Each section (A-K) is then depicted in greater detail in FIGS. 9*c*-9*n*.

Figure 9D:
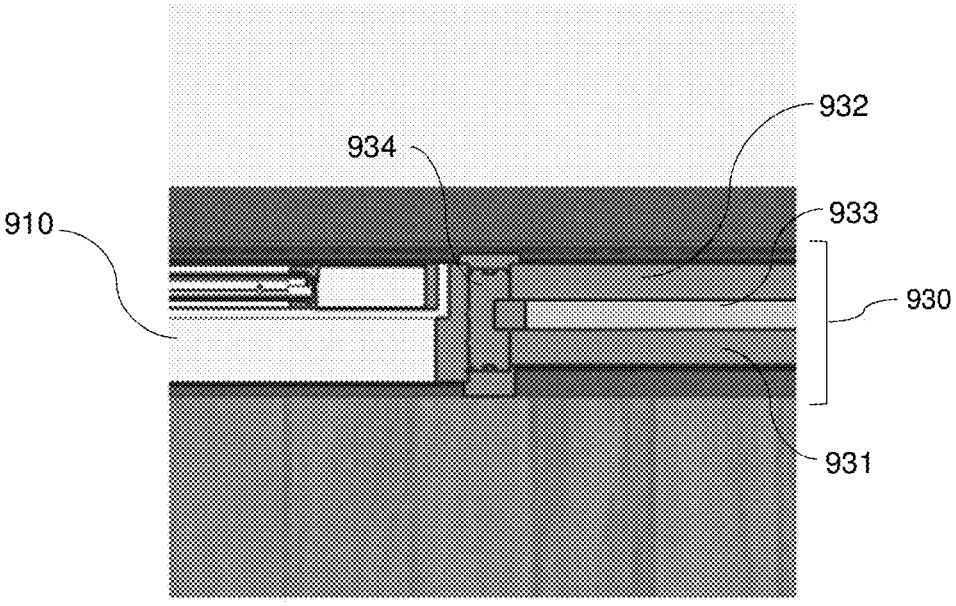
FIG. 9*d* is an enlarged view of portion A of the foldable living compartment of FIG. 9*a;*
Figure 9E:
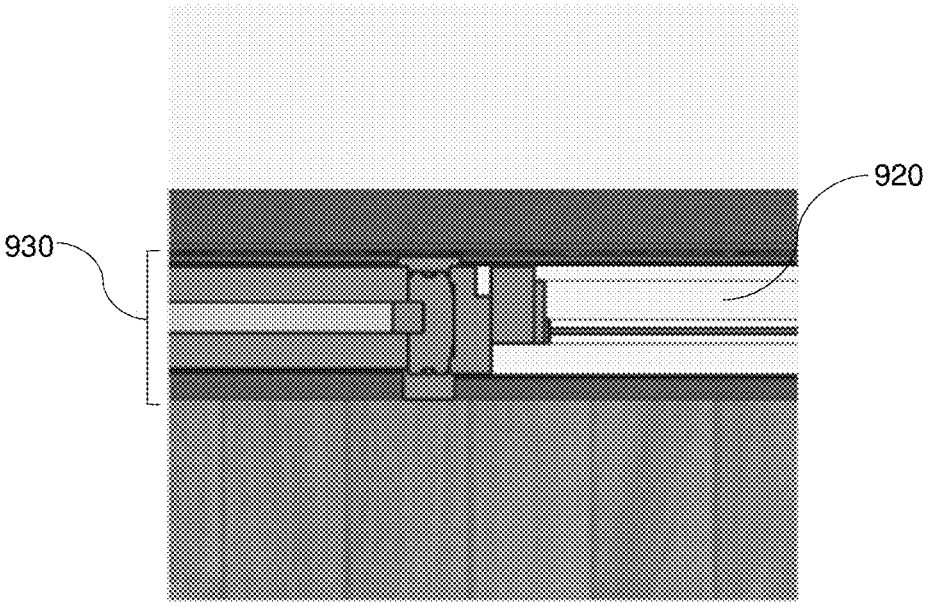
FIG. 9*e* is an enlarged view of portion B of the foldable living compartment of FIG. 9*a;*

FIG. 9*d* presents an enlarged view of section A, which depicts the junction between a door panel 910 and a sidewall panel 930. The sidewall panel 930 comprises an inner subpanel 931 and an outer subpanel 932, which are spaced apart from each other, encapsulating an insulated chamber 933 in between. A connector 934 is included between the door 910 and the sidewall panel 930 to connect the two building components and ensure good sealing at the joints. FIG. 9*e* shows section B in detail, illustrating the connection between a window 920 and a sidewall panel 930. Similar to FIG. 9*d*, FIG. 9*e* also demonstrates the double-wall structure of the sidewall panel 930, which serves to improve thermal and acoustic insulation.

Figure 9F:
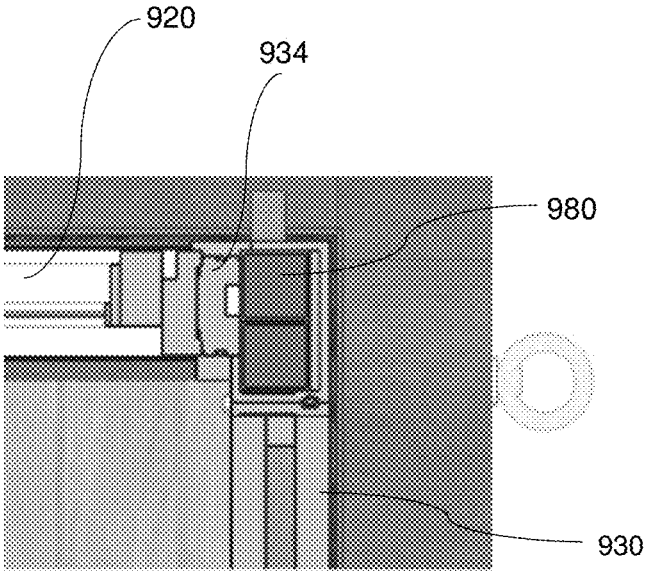
FIG. 9*f* is an enlarged view of portion C of the foldable living compartment of FIG. 9*a;*

FIG. 9*f* refers to section C which shows a corner of the living compartment 900. Adjacent to the corner is the window panel 920 and the sidewall panel 930. The structure of the living compartment is supported by the main frame 980. A connecter 934 is included between window 920 and the main frame 980 to ensure a secure physical connection between the two.

Figure 9G:
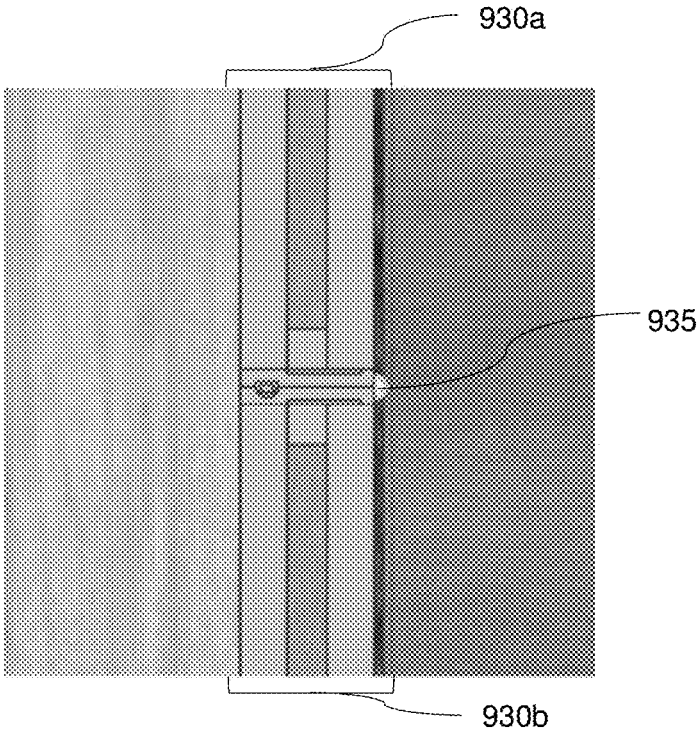
FIG. 9*g* is an enlarged view of portion D of the foldable living compartment of FIG. 9*a;*
Figure 9H:
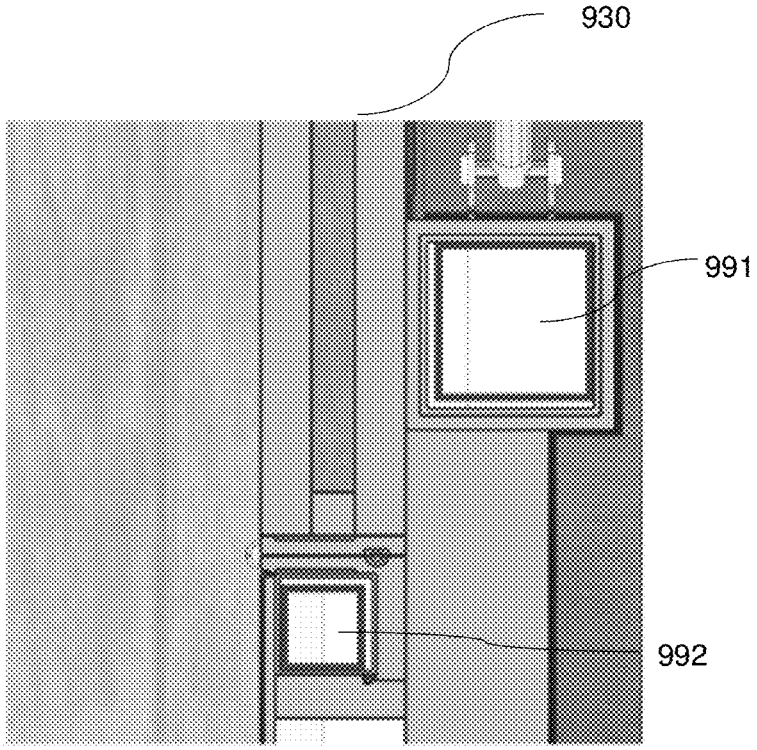
FIG. 9*h* is an enlarged view of portion E of the foldable living compartment of FIG. 9*a;*

Section D, as depicted by FIG. 9*g*, displays a portion of the sidewall where a first sidewall panel 930*a* is connected to a second sidewall panel 930*b* by a hinge 935, such that the first sidewall panel 930*a* is movable against the second sidewall panel 930*b*, enabling a folding movement between them. FIG. 9*h* demonstrates the cross-section of section E, which is the junction between the central structure and a sidewall panel 930. The central sidewall frame 992 supports the central sidewall panel, and is movably connected with the sidewall panel 930, allowing the sidewall panel to fold inwardly against the central structure. The central floor frame 991 provides structural support to the central floor panel. The floor frame 991 is movably connected to another floor frame member, allowing for foldable movement between the two.

Figure 9I:
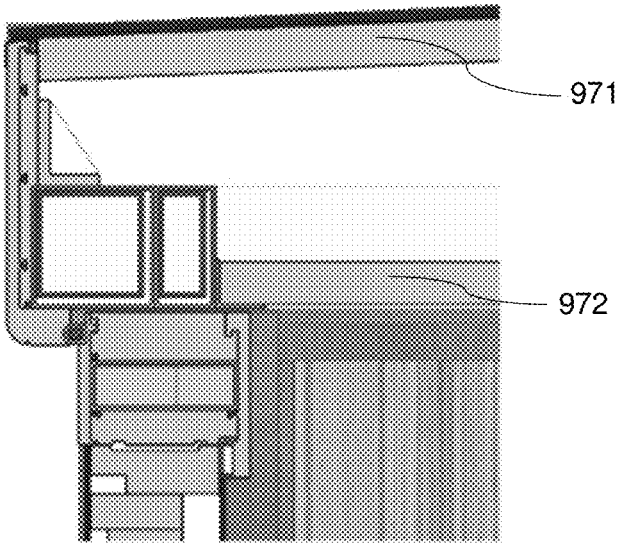
FIG. 9*i* is an enlarged view of portion F of the foldable living compartment of FIG. 9*b;*
Figure 9J:
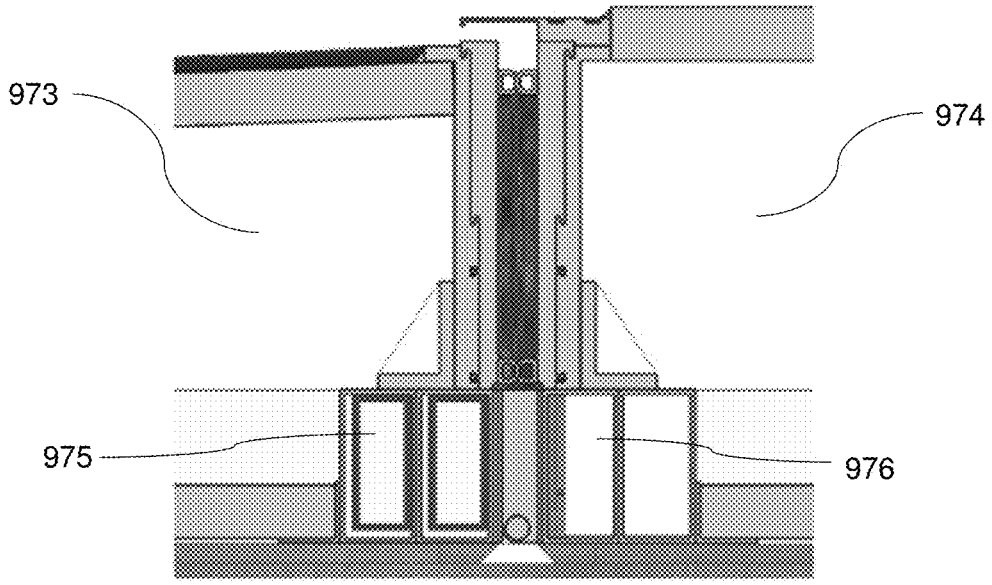
FIG. 9*j* is an enlarged view of portion G of the foldable living compartment of FIG. 9*b;*

Section F, as shown in FIG. 9*i*, displays a corner of the ceiling of the living compartment 900. The ceiling comprises an outer ceiling panel 971 and an inner ceiling panel 972, which are spaced apart to encapsulate a layer of air in between. FIG. 9*j* shows the ceiling portion at the junction between a ceiling member 973 and the central ceiling member 974, as seen in section G. The ceiling member 973 is supported by the ceiling frame member 975, and the central ceiling member 972 is supported by the central ceiling frame member 976. The ceiling frame members 975 and 976 are hinged together, allowing the ceiling member 973 to fold against the central structure.

Figure 9K:
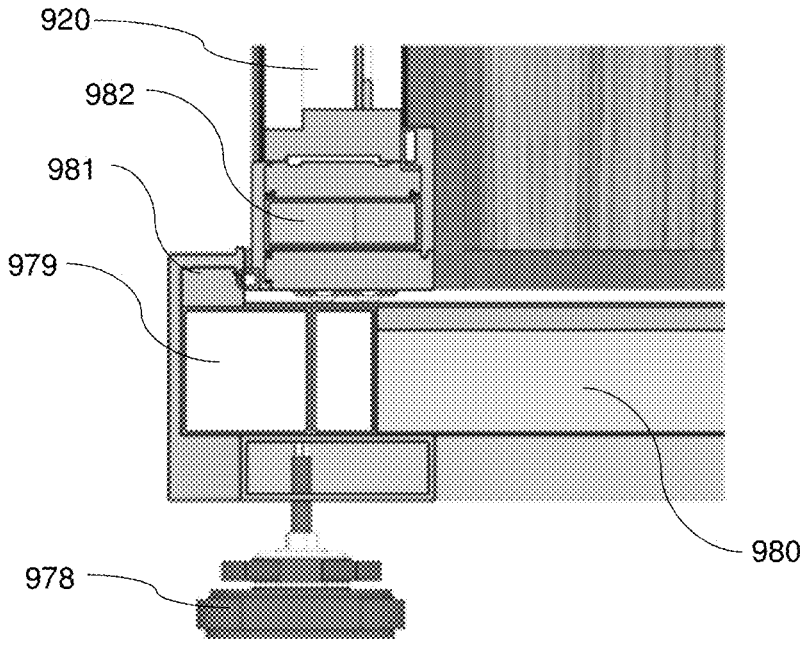
FIG. 9*k* is an enlarged view of portion H of the foldable living compartment of FIG. 9*b;*

FIG. 9*k* shows Section H, which is a corner formed by the floor 980 and the window 920. The floor frame member 979 provides structural support to the floor member 980. A protruded portion 981 is included at the edge of the floor frame member 979, which has a coupler on its inner surface that receives the sidewall frame member 982 when the sidewall panel 930 is fully expanded. The coupler may also have a locking mechanism that secures the connection between the floor frame member 979 and the sidewall frame member 981, maintaining the living compartment 900 in an expanded state. There is also an adjustment foot 978 between the floor 980 of the living compartment 900 and the ground for calibrating the floor level.

Figure 9L:
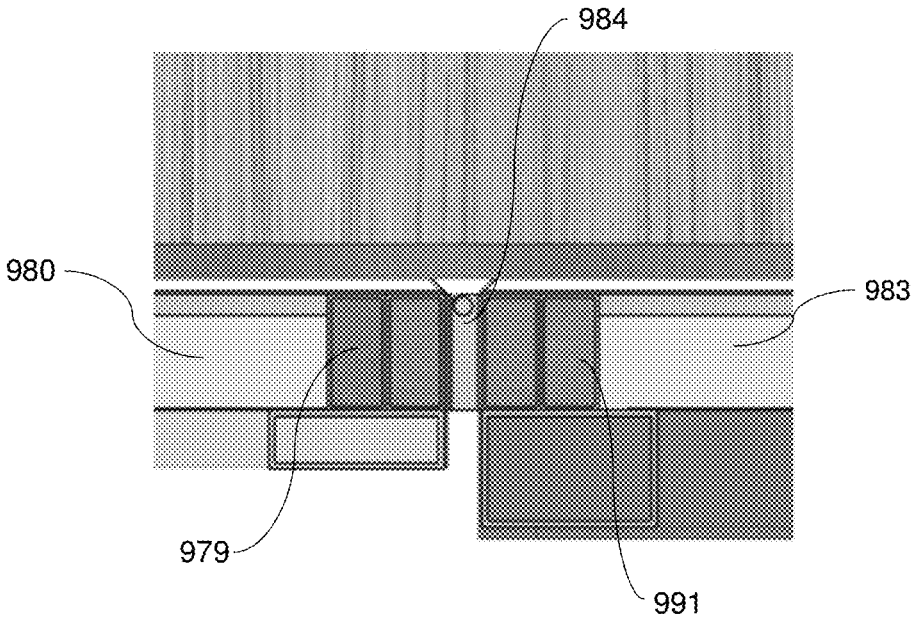
FIG. 9*l* is an enlarged view of portion I of the foldable living compartment of FIG. 9*b;*

FIG. 9*l* shows section I, which is the junction between the floor member 980 and the central floor member 983. As mentioned, the floor member 980 is supported by the floor frame member 979 while the central floor member 983 is supported by the central floor frame member 991. The two floor frame members 979, 985 are movably hinged 984 with each other allow the floor member 980 to fold upward against the central structure.

Figure 9M:
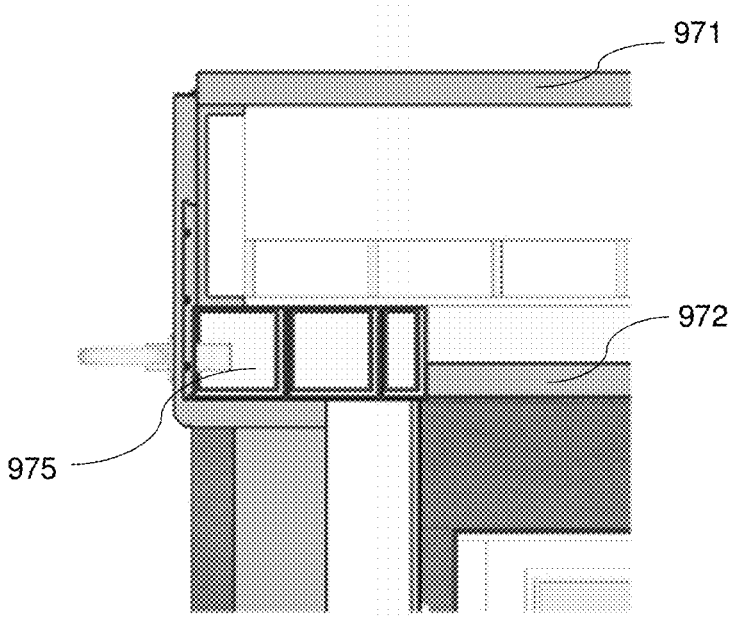
FIG. 9*m* is an enlarged view of portion J of the foldable living compartment of FIG. 9*c;*
Figure 9N:
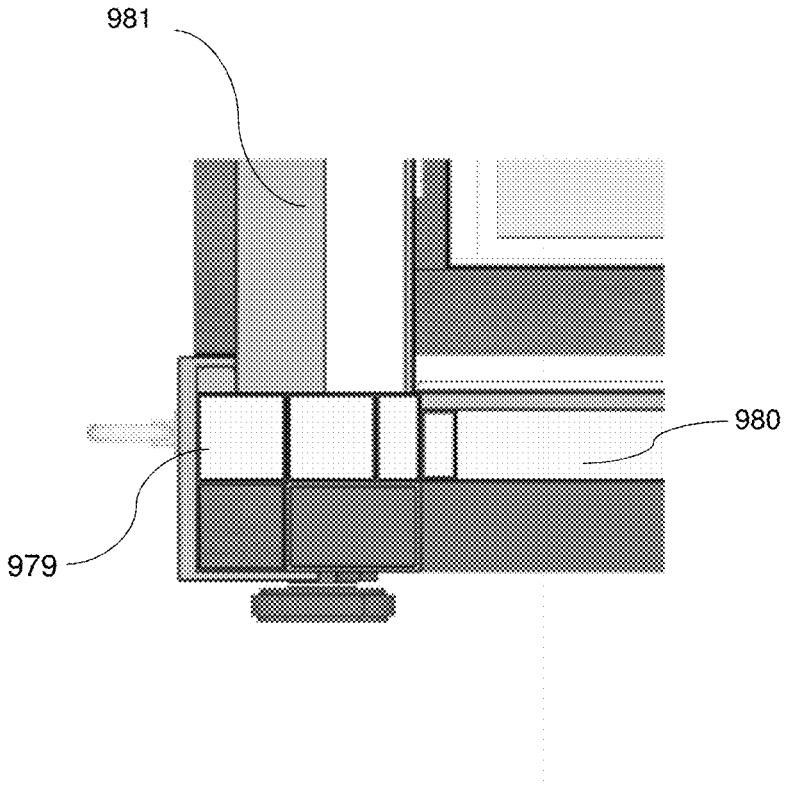
FIG. 9*n* is an enlarged view of portion K of the foldable living compartment of FIG. 9*d;*

Section J and Section K are represented by FIGS. 9*m* and 9*n* respectively. FIG. 9*m* shows an outer ceiling panel 971 and an inner ceiling panel 972, which are spaced apart to encapsulate a layer of air in between. The ceiling is supported by the ceiling frame member 975. FIG. 9*n* shows the floor frame member 979 providing structural support to the floor member 980. The floor frame member 979 is designed to make proper contact with the edge of the sidewall frame member 981. A sealing component may be added to improve insulation at the junction between the two frame members 979 and 981.

FIGS. 10-17 show the transition of the living compartment from a folded state to an expanded state.

Figure 10:
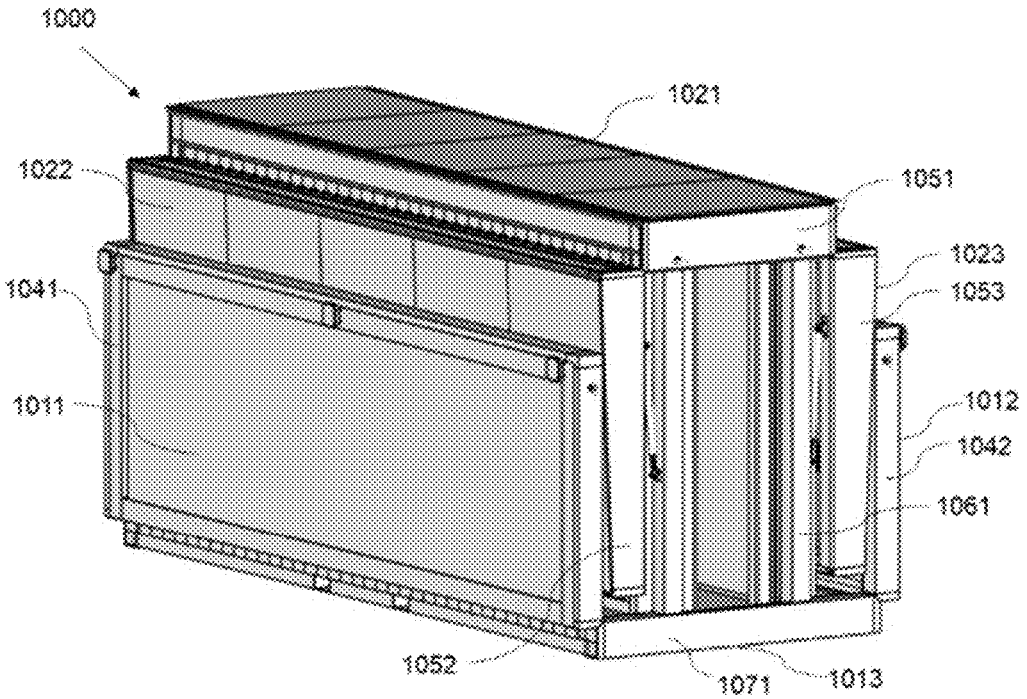
FIG. 10 is a perspective view of an embodiment of a foldable living compartment in a fully folded state according to the present invention.

Referring to FIG. 10, the living compartment 1000 is in a fully-folded state that the ceiling panels 1022, 1023 and the floor panels 1011, 1012 are folded against the central structure. The central frame is formed from the central ceiling frame member 1051, central sidewall frame member 1061 and central floor frame member 1071, which supports the central ceiling panel 1021, central sidewall panel, and the central floor panel 1013 and enables them to mount thereon.

The first and second ceiling panel 1022, 1023 are hingedly engaged to either side of the central ceiling panel 1021. Similarly, the first and second floor panels 1011, 1012 are hingedly engaged to both sides of the central floor panel 1013 such that they can fold against the central structure. As such, the living compartment 1000 comprises a first compartment on a first side of the central structure, and a second compartment on the opposite side of said central structure. This enables the living compartment 1000 to expand in two opposite directions.

In the present embodiment, the central floor frame member 1071 and the central floor panel 1013 formed thereon have a longer lateral length than that of the central ceiling frame member 1051 and its panel 1021. This is to allow the ceiling panels 1022, 1023 to fold inside the floor panels 1011, 1022 in the folded state. It also ensures a stable building structure which prevents the living compartment 1000 from toppling over in the face of an unexpected external force.

Figure 11:
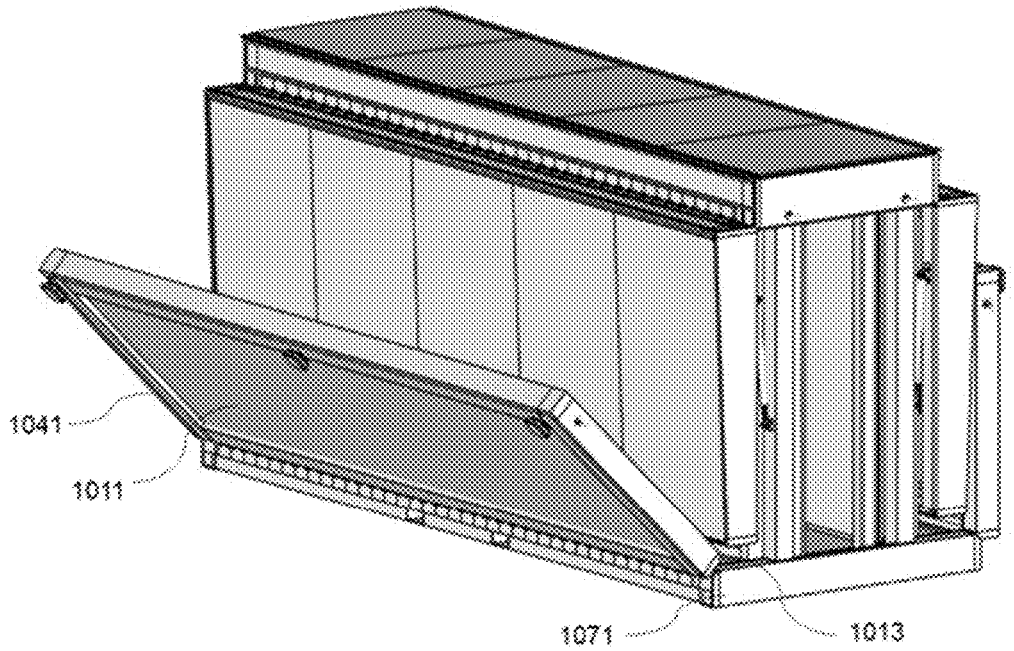
FIG. 11 is a perspective view of the foldable living compartment of FIG. 10 with a floor panel of a first compartment in an expanding state.
Figure 12:
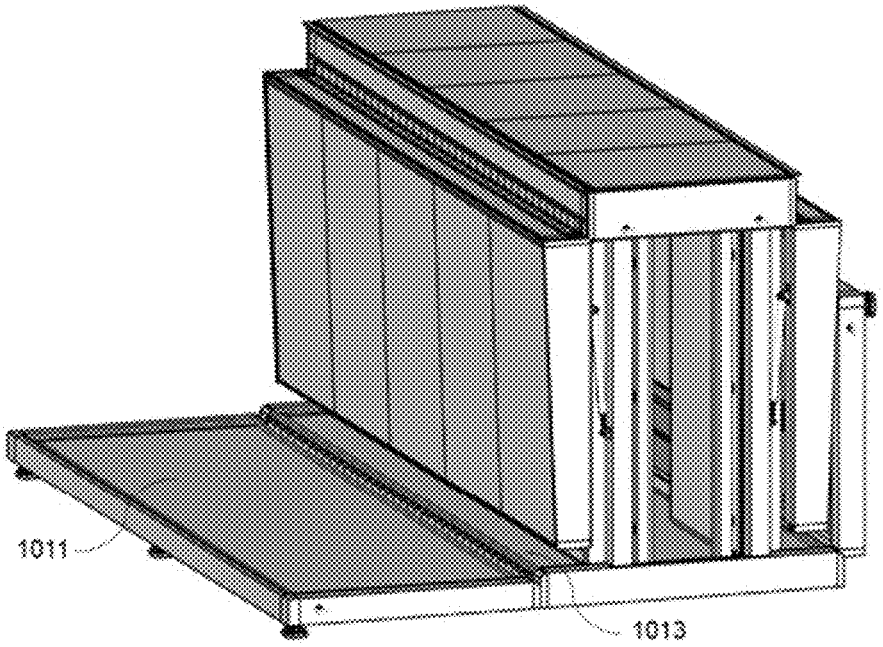
FIG. 12 is a perspective view of the foldable living compartment of FIG. 10 with a floor panel of a first compartment in a fully expanded state.

FIG. 11 shows a living compartment 1100 with a floor panel 1130 of the first compartment in an expanding state. With the floor frame member 1041 hingedly connected to the central floor frame member 1071, the floor panel 1011 formed thereon moves downwardly from a position substantially perpendicular to the central floor panel 1013. In FIG. 12, the living compartment has the floor panel 1011 in a fully expanded state, which is now on the substantially same horizontal plane as the central floor panel 1013.

Figure 13:
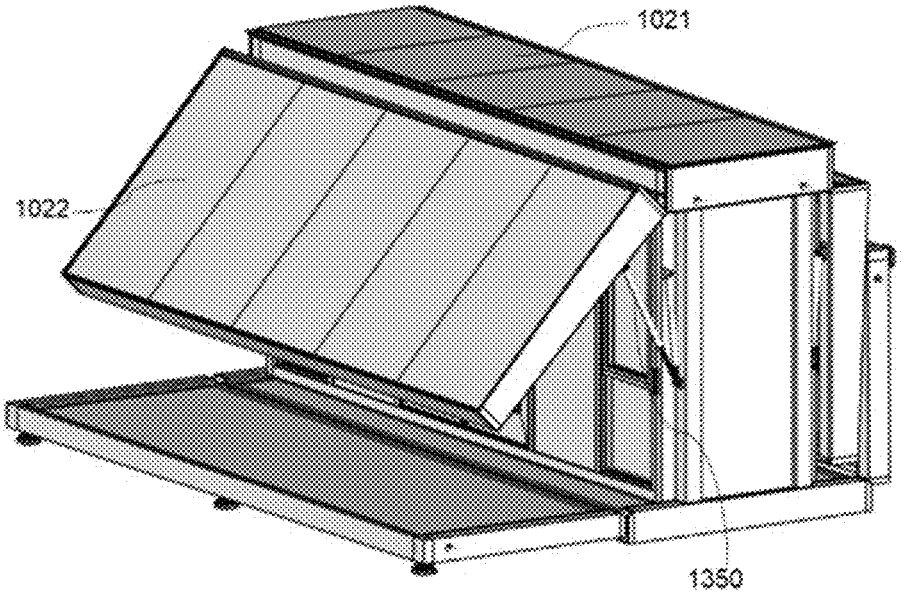
FIG. 13 is a perspective view of the foldable living compartment of FIG. 10 with a floor panel of a first compartment in a fully expanded state, and a ceiling panel thereof in an expanding state.
Figure 14:
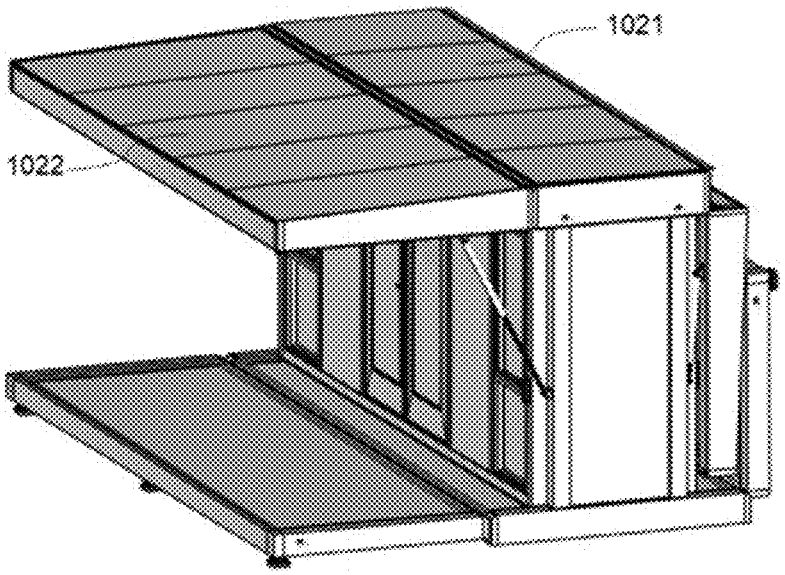
FIG. 14 is a perspective view of the foldable living compartment of FIG. 10 with both a floor panel and a ceiling panel of a first compartment in a fully extended state.

Similarly, FIGS. 13-14 show the movement of the ceiling panel 1022 moving from a folded position to an expanded position. In a folded position, the ceiling panel 1022 is substantially perpendicular to the central ceiling panel 1021, which upon the application of an upward force, the ceiling panel 1022 moves upwardly to an expanded position as shown in FIG. 14, which forms substantially the same horizontal plane with the central ceiling panel 1021.

In order to assist the upward movement of the ceiling panel 1022, a movement rod 1350 is included, which may be a nitrogen rod, a hydraulic rod or an electrically powered rod, and which is connected between the ceiling and the central sidewall frame. This allows the expansion of the ceiling panel 1022 to be carried out manually or automatically when powered by electricity.

upon the foldable compartment being transported in its folded state to the destination, the ceiling, the floor and the sidewall can be expanded and pushed outward using the manual or electric hydraulic rods or nitrogen rods. These rods can then be removed from the foldable compartment and be reused, reducing overall costs and saving time during installation. This eliminates the need for additional cranes or experienced manpower to control the equipment, and speeds up the process of opening the folded house and completing the installation.

Furthermore, the foldable compartment permits internal installation of electric cylinders with electric hydraulic or nitrogen rods. Holes have been designated for connecting electric control panels during the positioning process.

Figure 15A:
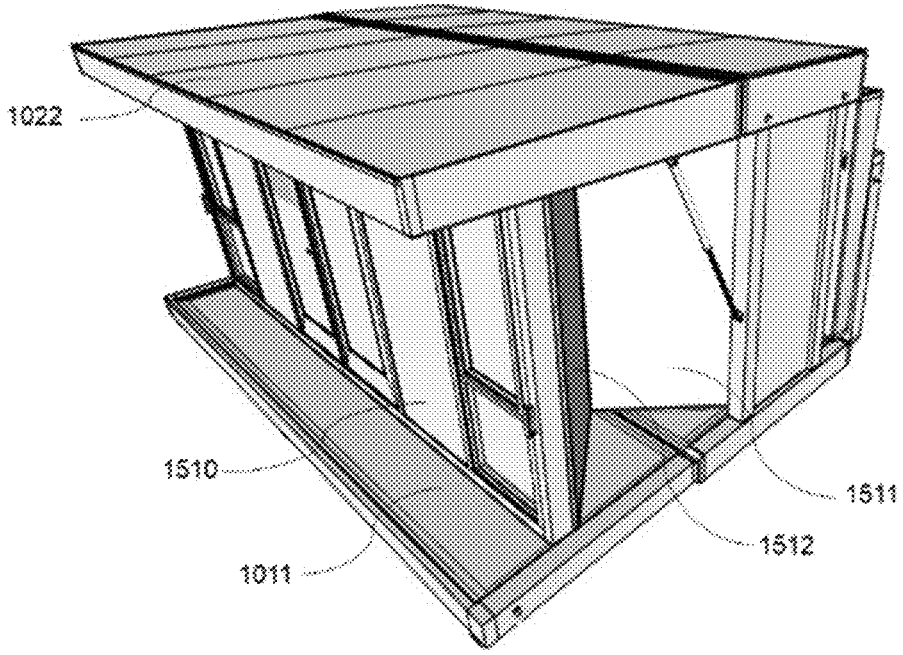
FIG. 15*a* is a perspective view of the foldable living compartment of FIG. 10 with sidewall panels of a first compartment in a first expanding state.
Figure 15B:
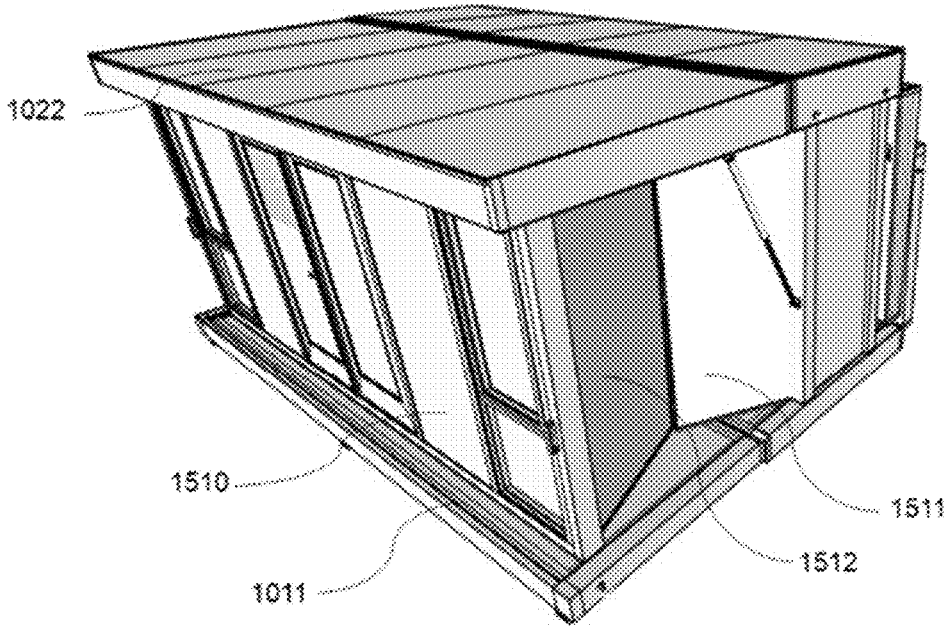
FIG. 15*b* is a perspective view of the foldable living compartment of FIG. 10 with sidewall panels of a first compartment in a second expanding state.
Figure 16:
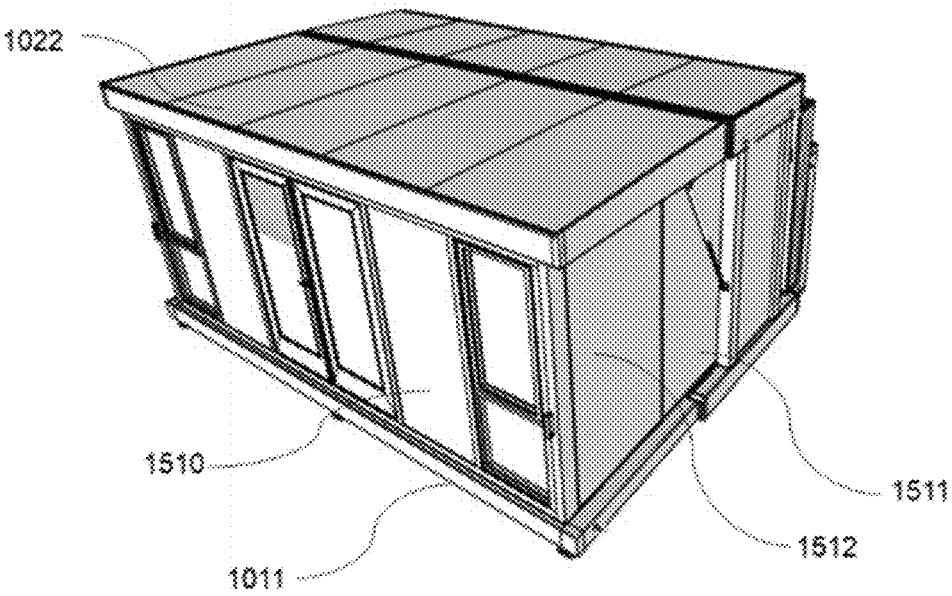
FIG. 16 is a perspective view of the foldable living compartment of FIG. 10 with a first compartment in a fully expanded state.

Referring to FIGS. 15*a*, 15*b* and 16 which demonstrate the expanding movement of the sidewall panels 1510, 1511, 1512. The first sidewall panel 1510 includes a door panel and window panels. At least a second sidewall panel 1511 and a third sidewall panel 1512 included, which are articulated with each other to allow foldable movement.

The same panel configuration applies to the opposite side of the second and third sidewall panels 1511, 1512, such that when folded, the first sidewall panel 1510 is adjacent to the central frame structure. When fully expanded, as shown in FIG. 16, the first sidewall panel 1510 is in contact with the outer edges of the expanded ceiling panel and the expanded floor panel.

Figure 17A:
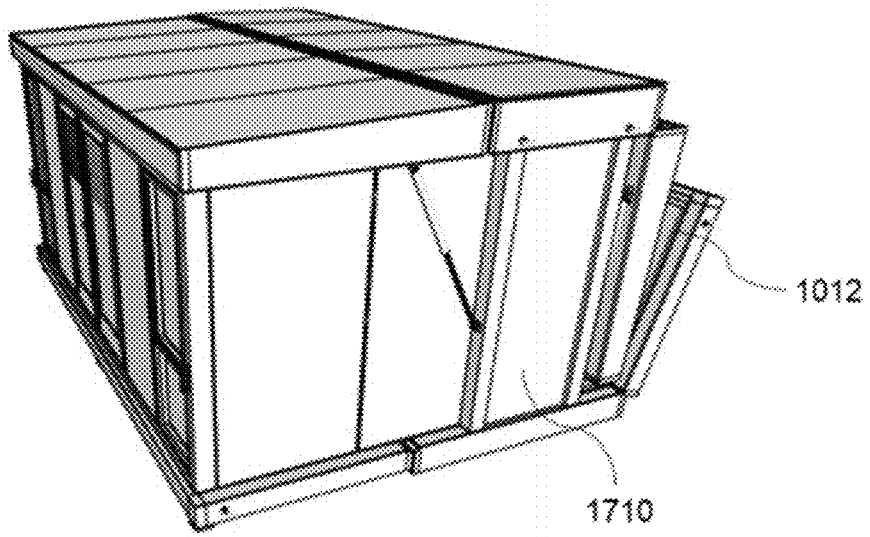
FIG. 17*a* is a perspective view of the foldable living compartment of FIG. 10 with a floor panel of a second compartment in an expanding state.
Figure 17B:
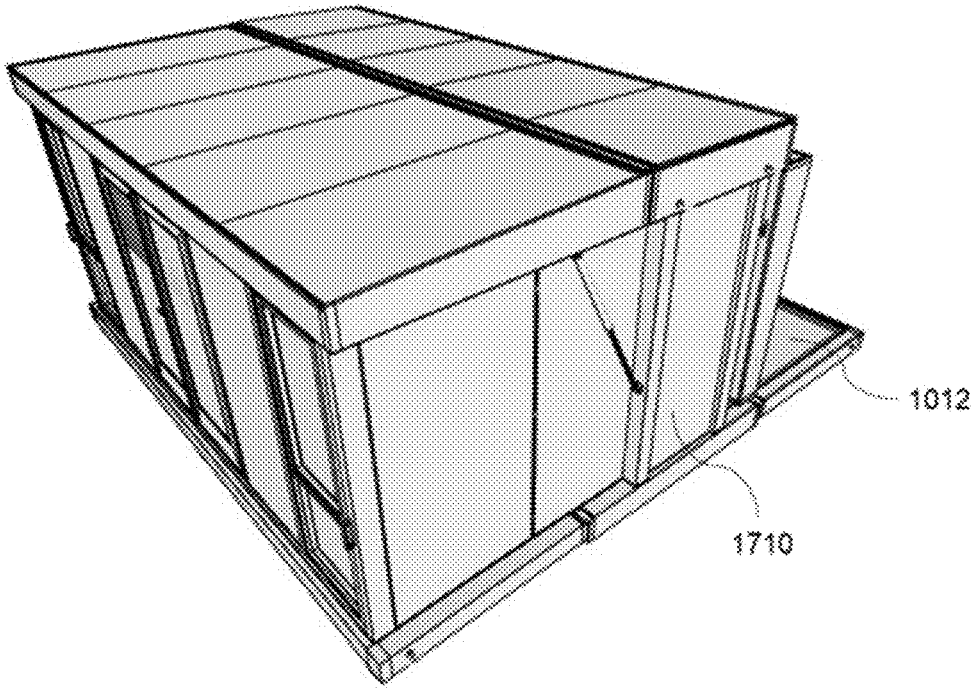
FIG. 17*b* is a perspective view of the foldable living compartment of FIG. 10 with a floor panel of a second compartment in a fully expanded state.
Figure 17C:
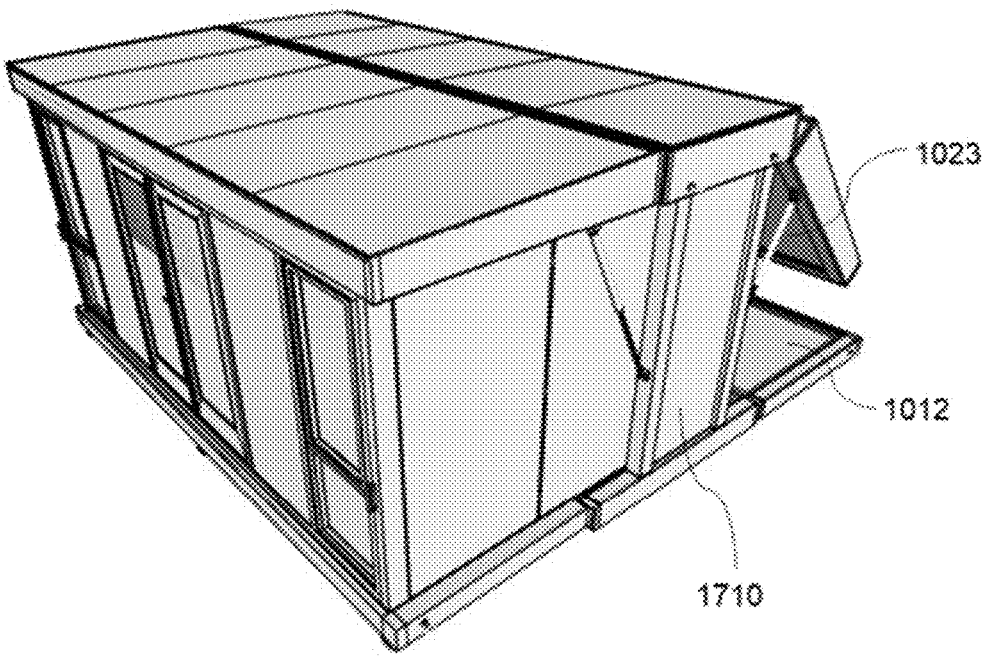
FIG. 17*c* is a perspective view of the foldable living compartment of FIG. 10 with a floor panel of a second compartment is a fully expanded state, and a ceiling panel thereof in an expanding state.
Figure 17D:
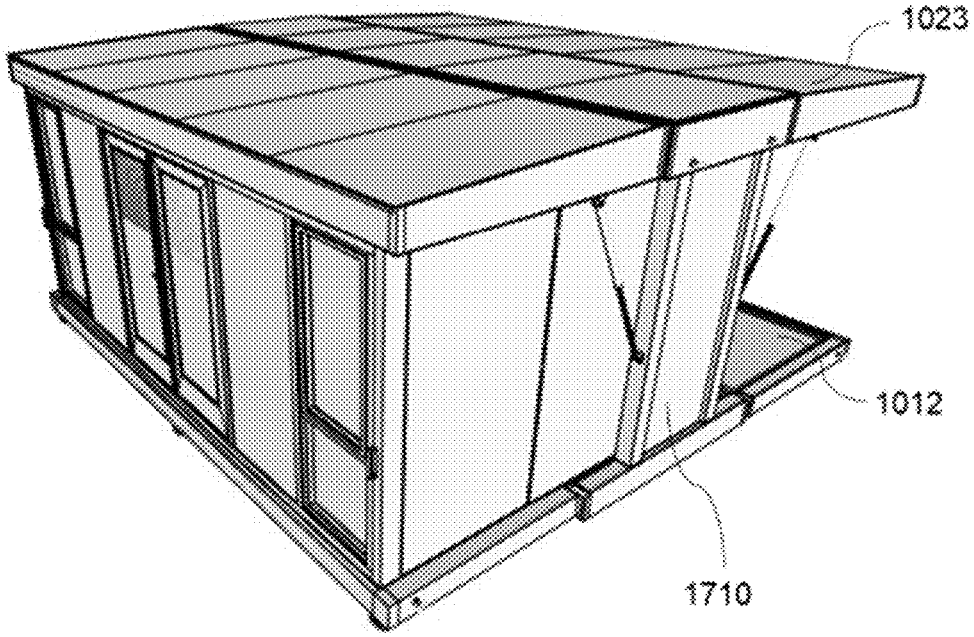
FIG. 17*d* is a perspective view of the foldable living compartment of FIG. 10 with both a floor panel and a ceiling panel in a fully expanded state.
Figure 17E:
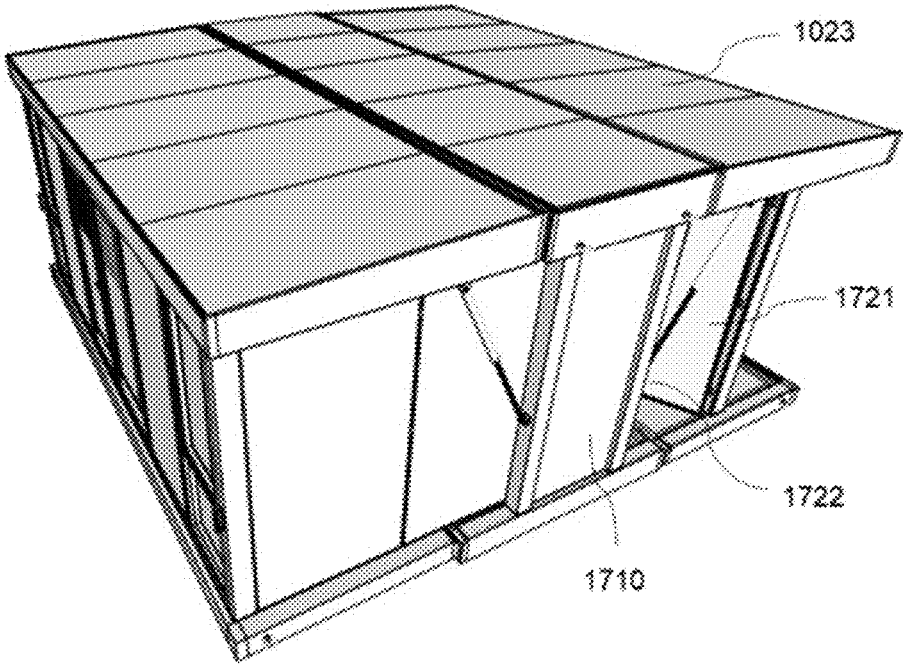
FIG. 17*e* is a perspective view of the foldable living compartment of FIG. 10 with sidewall panels in a first expanding state.
Figure 17F:
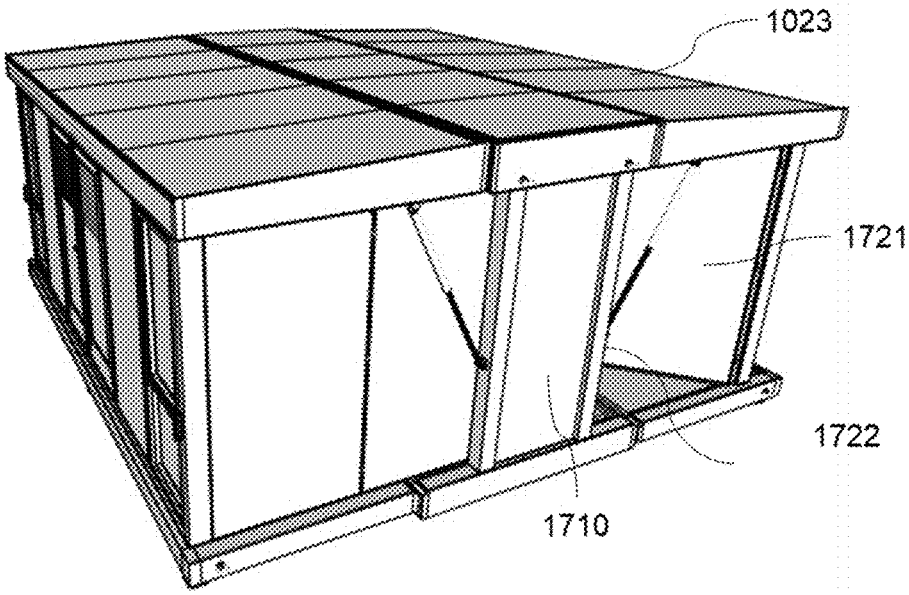
FIG. 17*f* is a perspective view of the foldable living compartment of FIG. 10 with sidewall panels in a second expanding state.
Figure 17G:
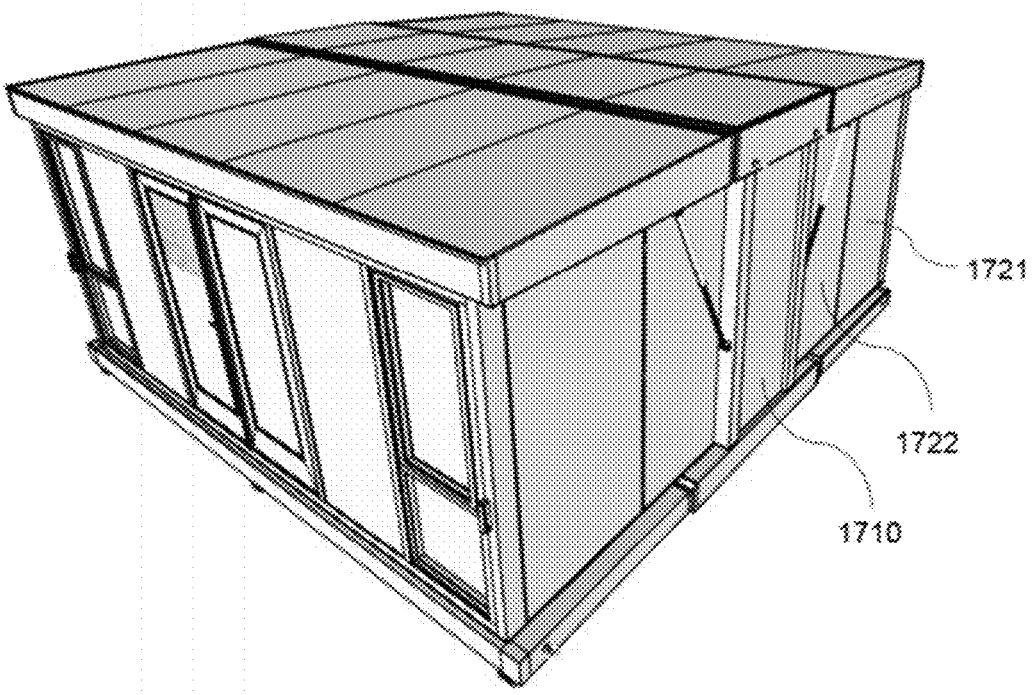
FIG. 17*g* is a perspective view of the foldable living compartment of FIG. 10 with both a first compartment and a second compartment in a fully expanded state.

FIGS. 10 to 16 illustrate the expansion of the first compartment, whereas FIGS. 17*a-g* illustrate the expansion of the second compartment which locates on the opposite side of the central structure 1710 in an opposite direction. As shown in FIGS. 17*a-d*, the floor panel 1012 is lowered to its fully expanded state in FIG. 17*b*, while the ceiling panel 1023 is pushed outwardly and upwardly to the fully expanded state in FIG. 17*d*. Referring now to FIGS. 17*e*-17*g*, the sidewall panels 1721, 1722 are hinged together to allow the second compartment to expand outwards and reach a fully expanded state as shown in FIG. 17*g*.

FIGS. 18 to 21 show the side views of the transition of the living compartment from a folded state to an expanded state. In particular, FIGS. 18*a*-18*e* demonstrate the expanding movement of a ceiling panel 1022 and a floor panel 1011 of the first compartment from a fully folded state as shown in FIG. 18*a*, to a fully expanded state as shown in FIG. 18*e*.

Figure 18A:
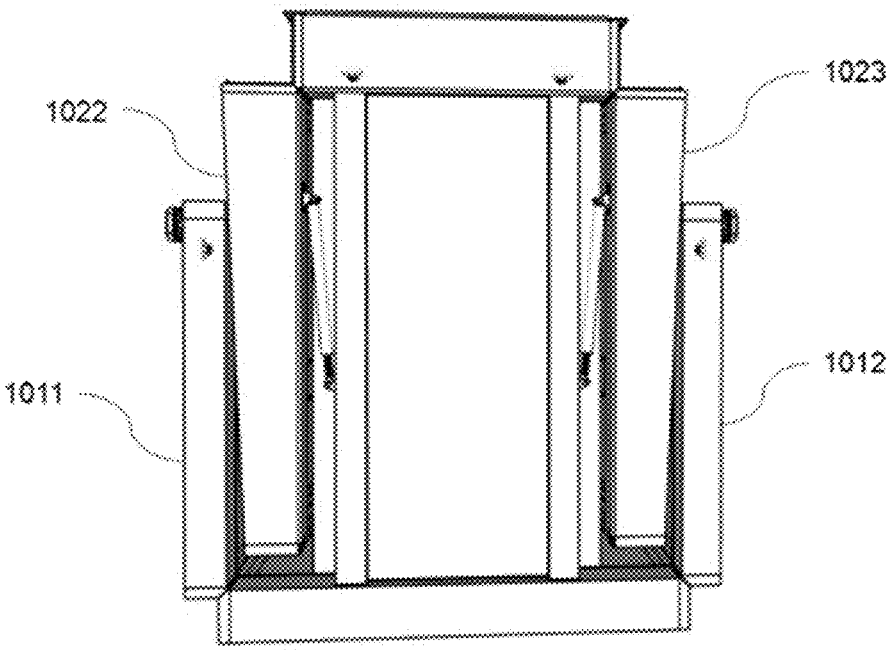
FIG. 18*a* is a side view of the foldable living compartment of FIG. 10 with both a first compartment and a second compartment in a fully folded state.
Figure 18B:
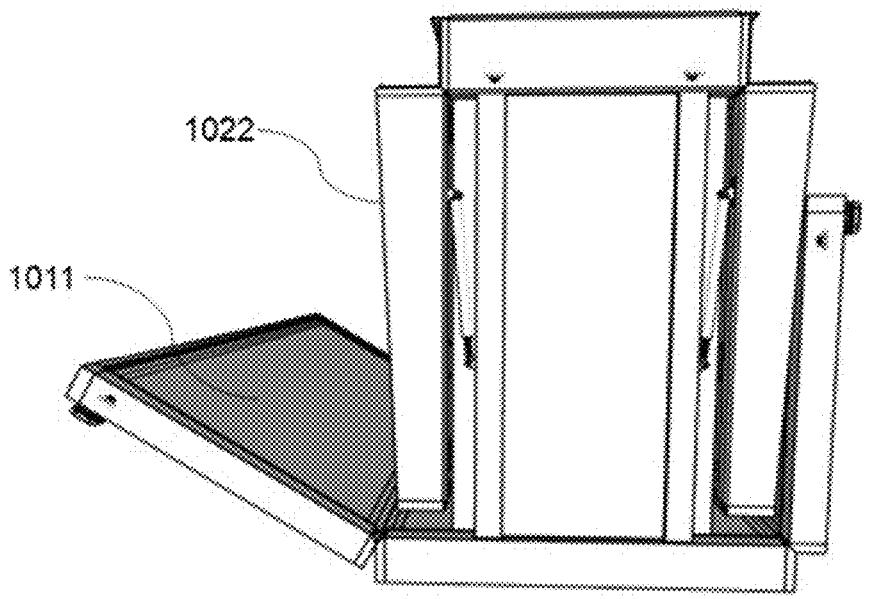
FIG. 18*b* is a side view of the foldable living compartment of FIG. 10 with a floor panel of a first compartment in an expanding state.
Figure 18C:
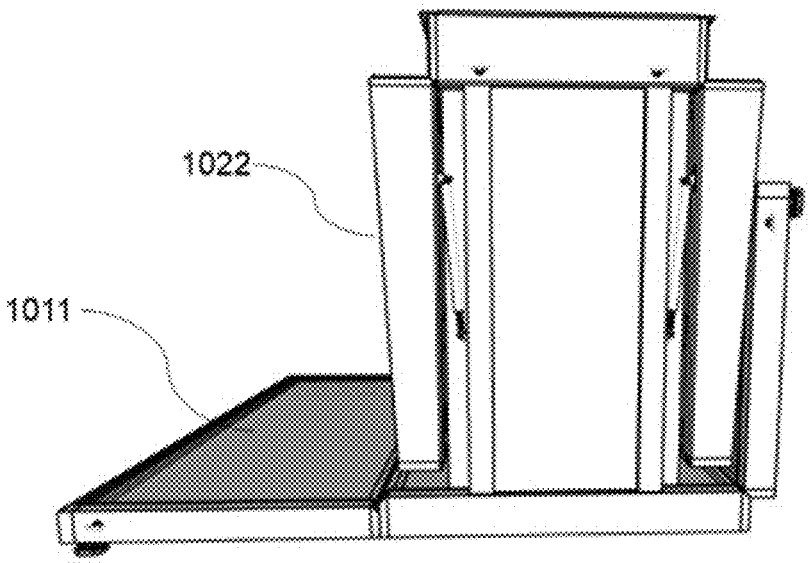
FIG. 18*c* is a side view of the foldable living compartment of FIG. 10 with a floor panel of a first compartment in a fully expanded state.
Figure 18D:
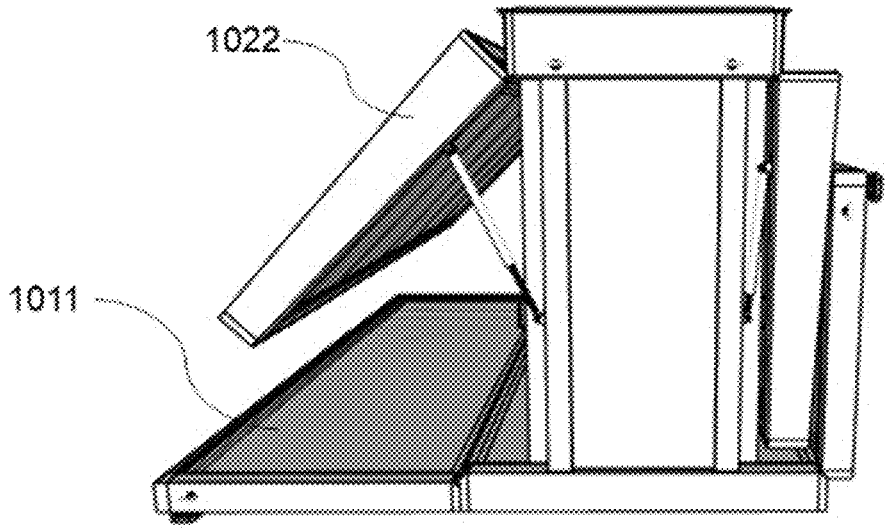
FIG. 18*d* is a side view of the foldable living compartment of FIG. 10 with a floor panel of a first compartment in a fully expanded state, and a ceiling panel thereof in an expanding state.
Figure 18E:
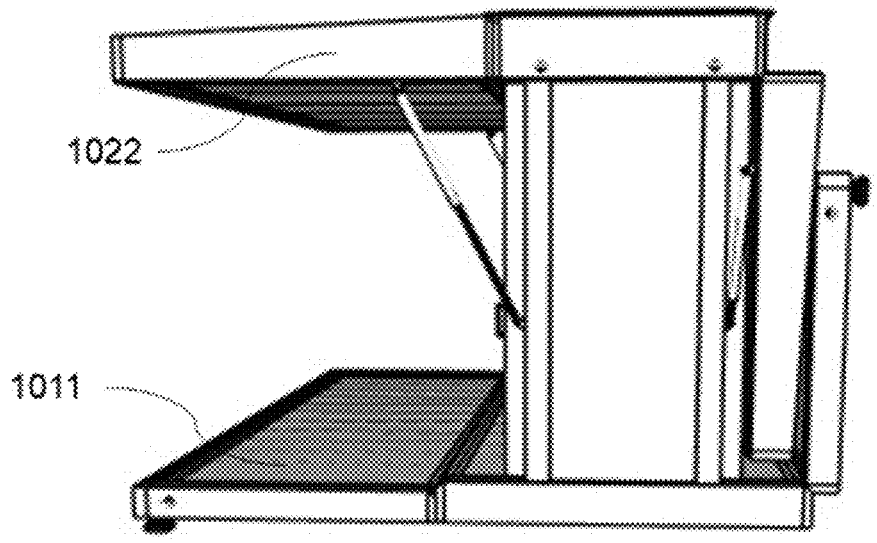
FIG. 18*e* is a side view of the foldable living compartment of FIG. 10 with both a floor panel and a ceiling panel of a first compartment in a fully expanded state

Same as FIG. 10, FIG. 18*a* depicts a fully folded state of the living compartment with the ceiling panels 1022, 1023 and the floor panels 1011, 1012 folded against the central frame structure.

Figure 19A:
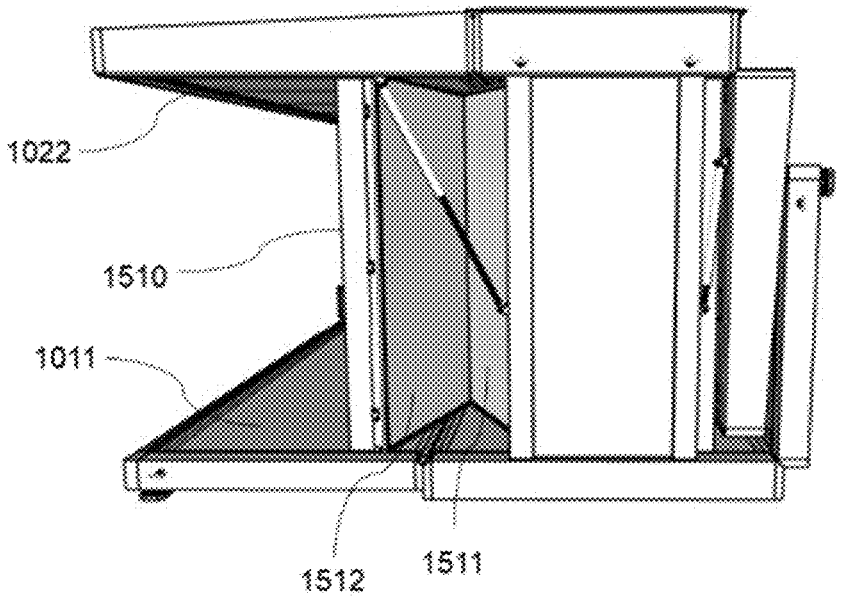
FIG. 19*a* is a side view of the foldable living compartment of FIG. 10 with sidewall panels of a first compartment in a first expanding state.
Figure 19B:
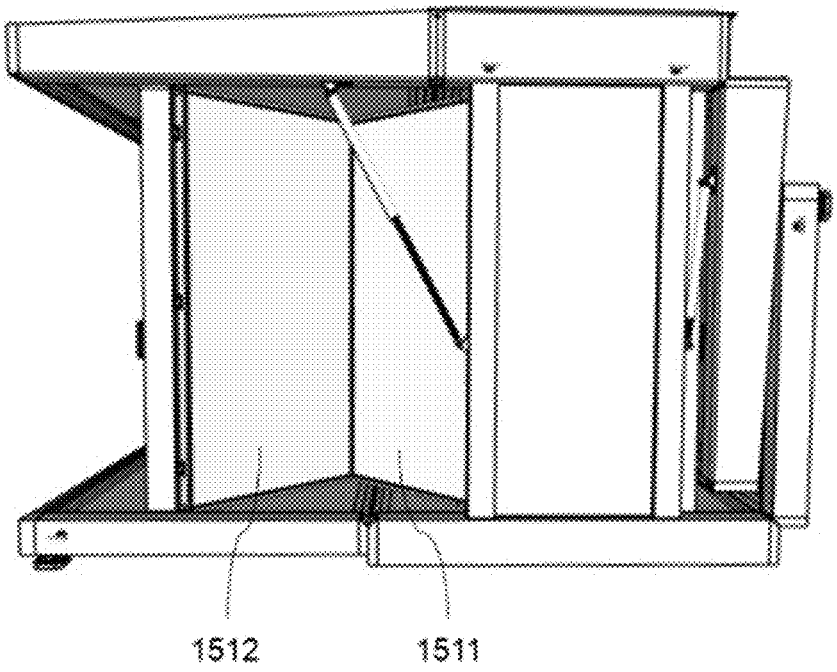
FIG. 19*b* is a side view of the foldable living compartment of FIG. 10 with sidewall panels of a first compartment in a second expanding state.
Figure 19C:
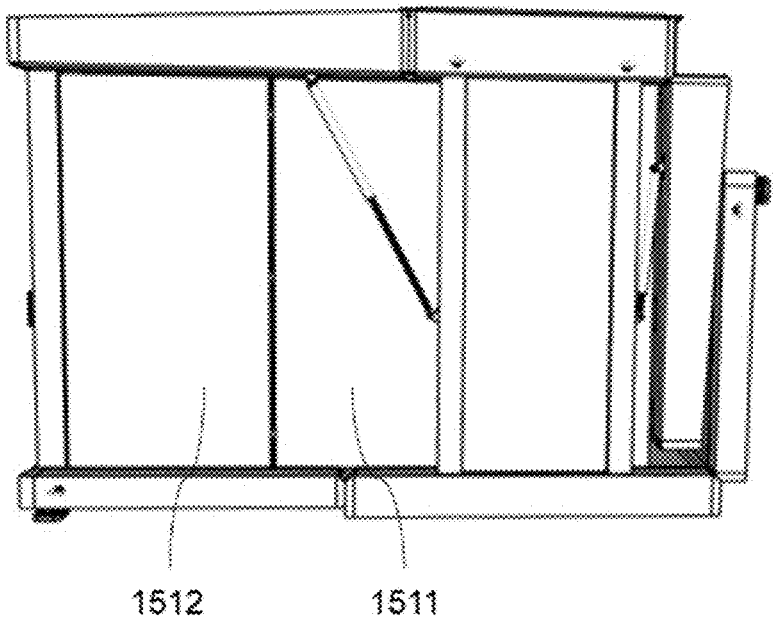
FIG. 19*c* is a side view of the foldable living compartment of FIG. 10 with sidewall panels of a first compartment in a fully expanded state.
Figure 19D:
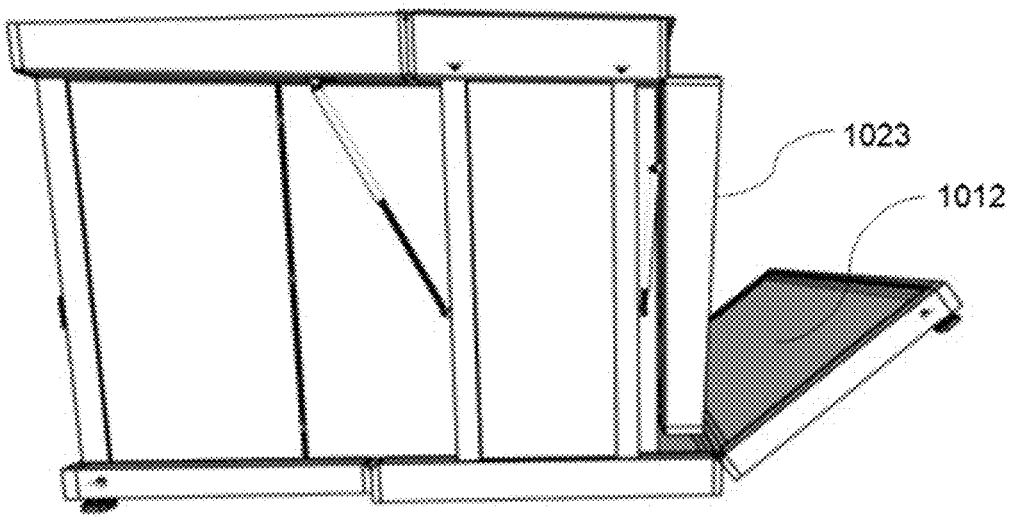
FIG. 19*d* is a side view of the foldable living compartment of FIG. 10 with a floor panel of a second compartment in an expanding state.
Figure 19E:
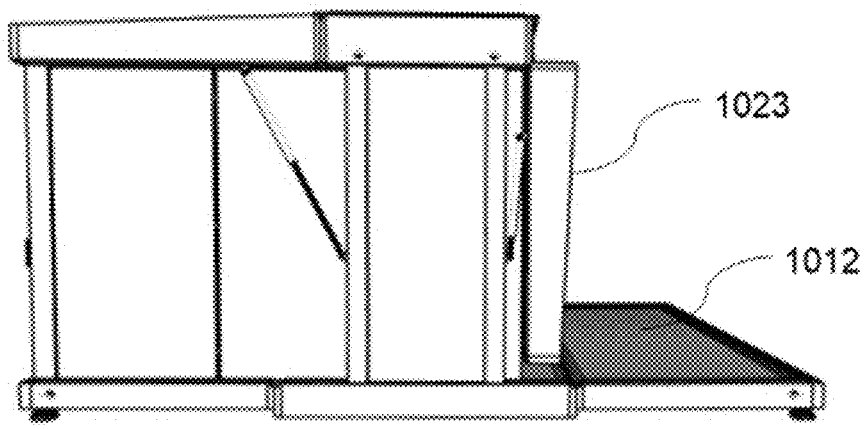
FIG. 19*e* is a side view of the foldable living compartment of FIG. 10 with a floor panel of a second compartment in a fully expanded state.
Figure 19F:
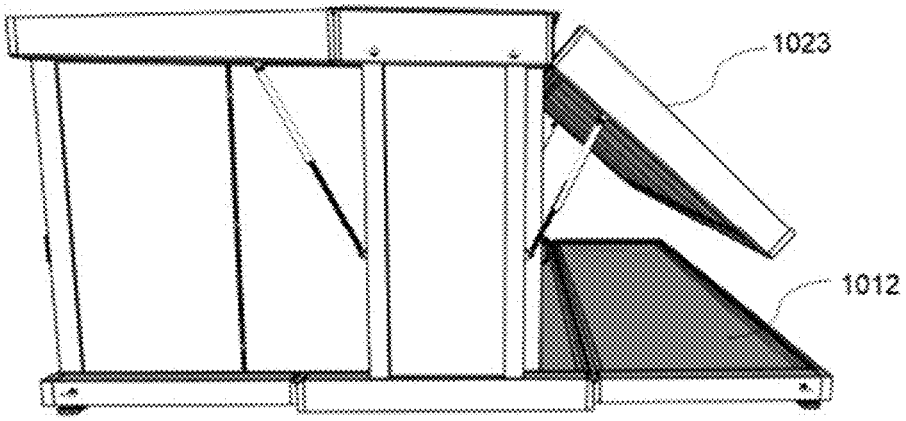
FIG. 19*f* is a side view of the foldable living compartment of FIG. 10 with a floor panel of a second compartment in a fully expanded state, and a ceiling panel thereof in an expanding state.
Figure 19G:
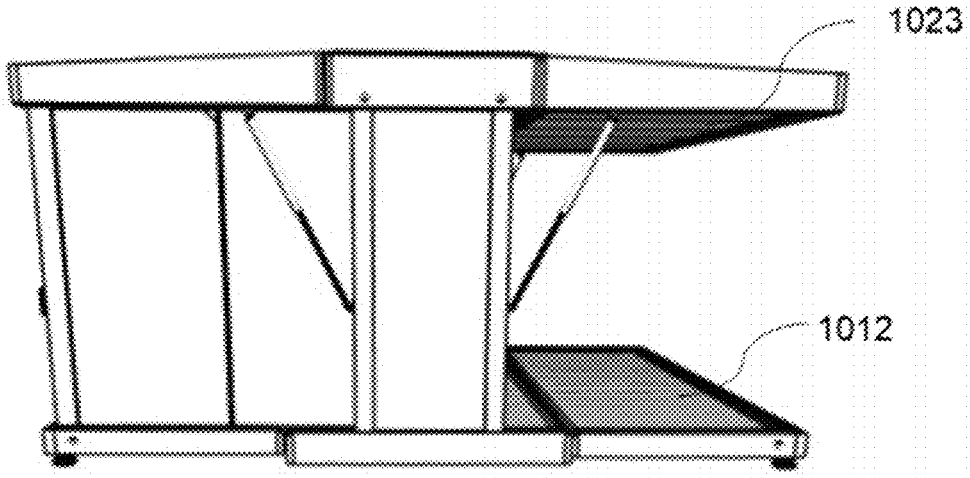
FIG. 19*g* is a side view of the foldable living compartment of FIG. 10 with both a floor panel and a ceiling panel of a second compartment in a fully expanded state.
Figure 20A:
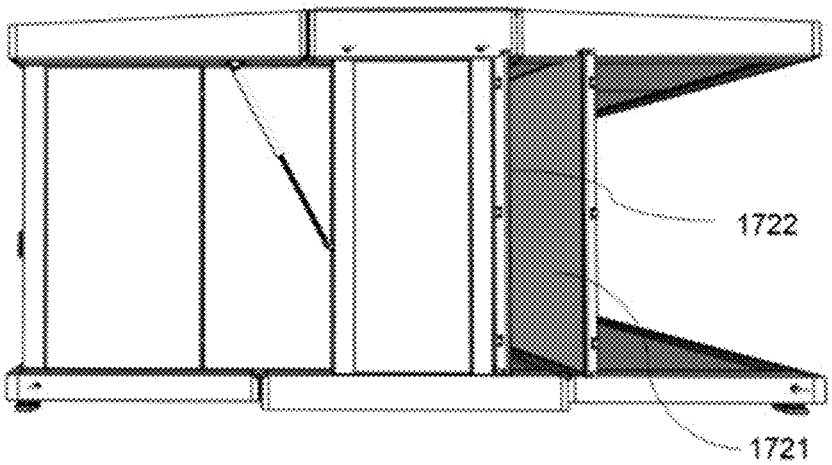
FIG. 20*a* is a side view of the foldable living compartment of FIG. 10 with sidewall panels of a second compartment in a first expanding state.
Figure 20B:
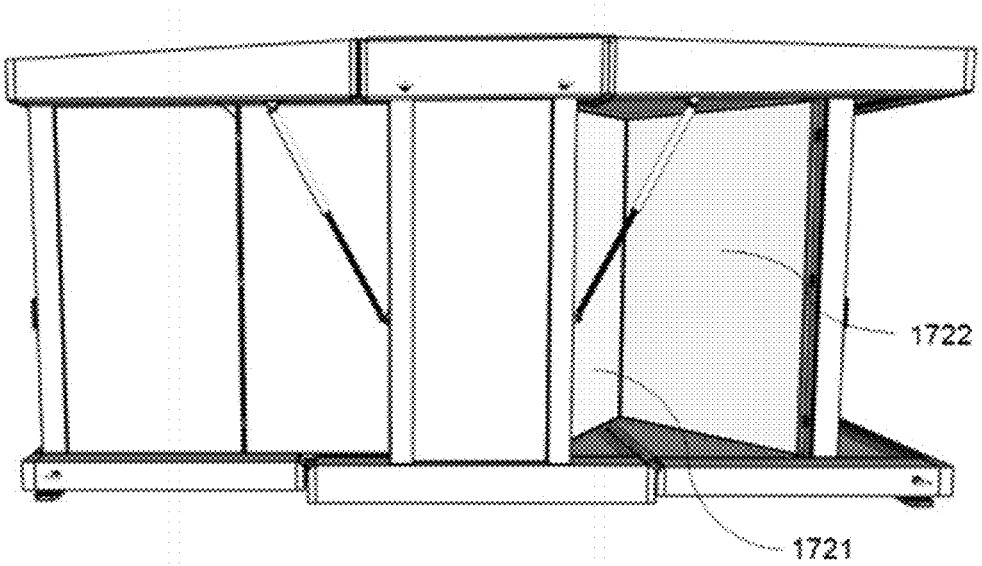
FIG. 20*b* is a side view of the foldable living compartment of FIG. 10 with sidewall panels of a second compartment in a second expanding state.

FIGS. 19*a*-19*c* demonstrate a fully expanded state of the first compartment, while the sidewall panels 1511, 1512 are in the course of expanding. These sidewall panels 1511, 1512 are hinged with each other such that upon an external force, the living compartment is expanded until the first sidewall panel 1510 reaches the outer edges of the ceiling panel 1022 and the floor panel 1011, as is shown in FIG. 19*c*. FIGS. 19*d*-19*g* continue to show the expansion of the second compartment, with a second floor panel 1012 being lowered down to the ground level and a second ceiling panel 1023 being pushed upward to an expanded state represented by FIG. 19*g*. As is shown in FIGS. 20*a*-20*b*, a first compartment on the left has been fully expanded while a second compartment is still in an expanding state. The sidewall 1721, 1722 are pushed outward until it reaches a fully expanded state as is shown in FIG. 21.

Figure 21:
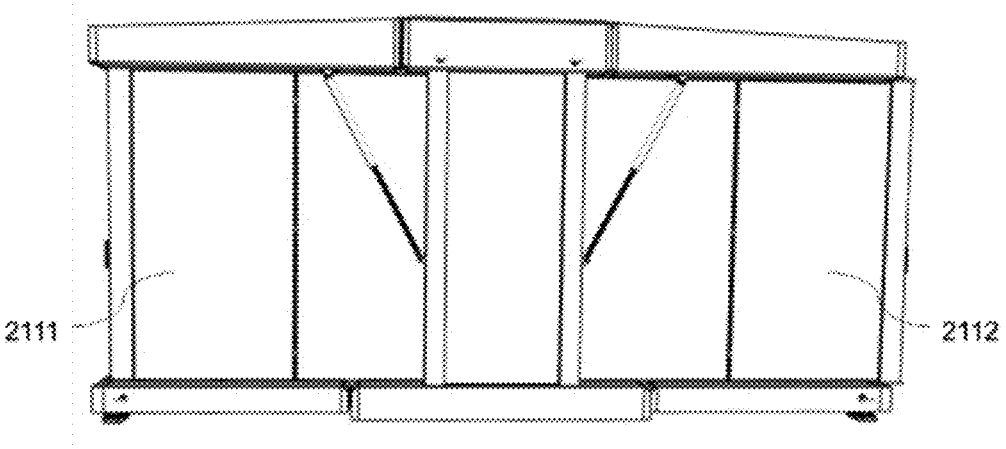
FIG. 21 is a side view of the foldable living compartment of FIG. 10 with both a first compartment and a second compartment in a fully expanded state.

FIG. 21 shows the fully expanded state of the living compartment, which is also a side view of FIG. 1*a*. Both the first compartment 2111 and the second compartment 2112 have been fully extended and is now ready for use.

Importantly, the present invention further includes the following features:

1. Rapid Assembly of Modular Walls

The present invention allows for separate manufacture of the wall panels, door, and window assembly in the factory, unlike the foldable containers of the prior art which require the entire container to be unitarily constructed. This one-stop production effectively reduces costs. Additionally, the structure of the sidewall panel of the present invention differs from the prior art in that the size of the sidewall panel can be pre-planned and produced in advance to meet different needs. On-site assembly at the factory can be completed quickly, effectively reducing the duration of work.

2. High Strength Sidewall Panel Materials

The sidewall panels are manufactured using SMC, which is highly resistant to flame, weather, and corrosion. The SMC contains glass fibre bundles to enhance its strength, and is mixed with resin and high-pressure moulded. In an embodiment, the exterior surface of a sidewall panel has a wood grain texture, making it a suitable replacement for wood. Furthermore, it is completely non-absorbent and resistant to pests and insects.

3. Thermal and Acoustic Insulation

The sidewall panels have a double-wall structure that encloses a layer of air. The sidewall panel consists of two SMC surface material pieces with PVC foam sealing. To achieve lightweight and sound insulation, as well as other insulation characteristics, the chamber within the sidewall panel is filled with PU foam. The wall can also be reinforced with internal wood, steel or composite materials, depending on the strength requirements.

4. Double Wall Design for Wiring and Piping Installation

The insulated chamber between the double-walled sidewall panels form passageway, which can accommodate network wires, electrical cables, or pipes. This increases thermal resistance and facilitates pre-burial of pipelines. Sockets or tubes should be installed by drilling holes in the wall according to the required positions.

5. Quick Assembly Insert Structure

The wall cladding has been improved to enhance the embedded or locking structure, enabling quick assembly. Furthermore, an airtight strip has been included to seal the joints of the components, enhancing water and airtightness.

6. Solar Panels and Home Energy Storage Cabinets

Solar panels can be installed on the roof of the living compartment and connected to a home energy storage unit to store electricity. This enables the use of off-peak power to store energy.

Sidewall panels and door/window modules of the present invention can be easily replaced as they are formed on the main frame. These panel modules can be dismantled and installed at any time, and they come in various sizes according to different needs. The inner and outer walls of the sidewall panels can have their colour and pattern customized during production, reducing consumables for future renovations and carbon emissions.

Additionally, the living compartment of the present invention can be changed between a folded state and an expanded state in one continuous action, eliminating the need to fold each wall individually.

The invention claimed is:

1. A foldable living compartment comprising:

a ceiling, a floor, first sidewall, a second sidewall, and a third sidewall positioned opposite the second sidewall, the sidewalls being connected to one another and disposed between the ceiling and the floor in an expanded state, wherein each of the second sidewall and the third sidewall comprises two or more panels engaged with each other to enable the living compartment to transit between the expanded state and a collapsed state, each of the sidewall panels comprising:

(i) a first subpanel, (ii) a second subpanel opposing the first subpanel, and spaced from the first subpanel, (iii) sealing components sealing peripheries of the first subpanel and the second subpanel to define a sealed chamber in which air is trapped, (iv) an exterior cover plate, (v) a central wall panel located between the subpanels and the exterior cover plate, wherein each of the first subpanel and the second subpanel has a second thickness, wherein the foldable living compartment further comprises a frame structure including: a central frame, the central frame having a ceiling frame member, a floor frame member, and sidewall members, the floor frame member of the central frame having a longer lateral length than a lateral length of the ceiling frame member of the central frame, the ceiling being coupled to the ceiling frame member to move relative to the ceiling frame member between a stored state in which the second and the third sidewalls are in a collapsed state and a deployed state in which the second and third sidewalls are in the expanded state, the floor being coupled to the floor frame member to move relative to the floor frame member between a stored state in which the second and the third sidewalls are in a collapsed state and a deployed state in which the second and the third sidewalls are in a expanded state, wherein in the stored state the ceiling is outside a boundary of the ceiling frame member entirely but over the floor frame member, and in the stored state the floor is outside the boundary of the ceiling frame member, wherein at least one of the ceiling, the floor, and one of the sidewalls comprises a metal frame that acts as a thermal bridge covered with an insulating frame cover, wherein the ceiling comprises a ceiling panel assembly that includes an outer ceiling panel, an inner ceiling panel held in position by a supporting frame such that an insulated chamber of the ceiling panel assembly is defined between the outermost and innermost ceiling panels, a frame and a cover, edges of the cover being sealed with sealing components to further enhance insulation, wherein the first and the second subpanels are made of PVC with glass fiber material or ready-to-mould glass-fiber reinforced polyester material attached on both sides, wherein the insulated chamber has a thickness of at least 30 mm, wherein the insulated chamber has a lower thermal conductivity than that of the first and the second subpanels.

2. The foldable living compartment according to claim 1, wherein the living compartment is configured to have a maximum volume in the expanded state and a minimum volume in the collapsed state, the maximum volume to minimum volume ratio is about 2.8 to 1.66.

3. The foldable living compartment according to claim 1, wherein the first subpanel and the second subpanel are spaced apart at a distance adjustable to provide a predetermined insulation effect.

4. The foldable living compartment according to claim 1, wherein the floor comprises one or more floor panels, wherein each of the floor panels comprises:

(i) a first floor subpanel, and (ii) a second floor subpanel opposing the first floor subpanel, wherein the first floor subpanel is spaced apart from the second floor subpanel defining a chamber trapping a layer of air therebetween.

5. The foldable living compartment according to claim 1, further comprising supplementary frame members, configured to provide mechanical reinforcement to the ceiling, the floor and the sidewalls.

6. The foldable living compartment according to claim 5, wherein the supplementary frame members are positioned within a respective chamber in each of the ceiling, the floor, and the sidewalls.

7. The foldable living compartment according to claim 1, wherein the first sidewall includes a door, a window or a combination thereof.

8. The foldable living compartment according to claim 1, wherein the ceiling panel assembly comprises a first ceiling panel and a second ceiling panel.

9. The foldable living compartment according to claim 8, wherein the first ceiling panel is in engagement with the sidewalls, and the second ceiling panel is movably connected with the first ceiling panel to enable the second ceiling panel to move relative to the first ceiling panel.

10. The foldable living compartment according to claim 9, wherein the second ceiling panel is connected to the sidewalls via a hydraulic arm or a powered rod.

11. The foldable living compartment according to claim 1, wherein the floor comprises a first floor panel and a second floor panel.

12. The foldable living compartment according to claim 11, wherein the first floor panel is in engagement with second edges of the sidewalls, and the second floor panel is movably connected with the first floor panel to enable relative movement therebetween.

13. The foldable living compartment according to claim 1, wherein the panels of the second sidewall are connected with each other in a manner to enable the transition between the expanded and collapsed states to proceed in a continuous motion, and wherein the panels of the third sidewall are connected with each other in a manner to enable the transition between the expanded and collapsed states to proceed in a continuous motion.

14. The foldable living compartment according to claim 1, further comprising an insulating material residing in the insulated chamber of the ceiling panel assembly, wherein the at least one insulating material comprises PVC.

15. The foldable living compartment according to claim 1, wherein the ceiling comprises a beam holder that includes a plurality of beam members made of acrylonitrile butadiene styrene.

* * * * *